US011242213B2

(12) United States Patent
Zaitsu et al.

(10) Patent No.: US 11,242,213 B2
(45) Date of Patent: Feb. 8, 2022

(54) SHEET FEEDING DEVICE AND IMAGE FORMING APPARATUS

(71) Applicants: Daikai Zaitsu, Kanagawa (JP); Rie Ohtsuka, Tokyo (JP); Junichi Sugita, Tokyo (JP); Mamoru Kambayashi, Tokyo (JP)

(72) Inventors: Daikai Zaitsu, Kanagawa (JP); Rie Ohtsuka, Tokyo (JP); Junichi Sugita, Tokyo (JP); Mamoru Kambayashi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 154 days.

(21) Appl. No.: 16/690,715

(22) Filed: Nov. 21, 2019

(65) Prior Publication Data

US 2020/0165086 A1 May 28, 2020

(30) Foreign Application Priority Data

Nov. 26, 2018 (JP) ..... JP2018-219900

(51) Int. Cl.
*B65H 3/34* (2006.01)
*B65H 3/06* (2006.01)
(Continued)

(52) U.S. Cl.
CPC ..... *B65H 3/0669* (2013.01); *B65H 5/26* (2013.01); *B65H 3/34* (2013.01); *B65H 3/56* (2013.01); *B65H 3/565* (2013.01); *B65H 2405/1134* (2013.01)

(58) Field of Classification Search
CPC ..... B65H 3/34; B65H 3/56; B65H 2405/1134
See application file for complete search history.

(56) References Cited

U.S. PATENT DOCUMENTS 5,419,544 A 5/1995 Ono et al.
5,433,428 A 7/1995 Akashi
(Continued)

FOREIGN PATENT DOCUMENTS

CN 1105759 A 7/1995
CN 101746621 A 6/2010
(Continued)

OTHER PUBLICATIONS

Chinese Office Action dated Nov. 27, 2020.
Extended European Search Report dated Apr. 24, 2020.

*Primary Examiner* — Howard J Sanders
(74) *Attorney, Agent, or Firm* — Harness, Dickey & Pierce, P.L.C.

(57) ABSTRACT

A sheet feeding device includes a feeder, a contact member, a movement restricting member, a moving mechanism, and control circuitry. The feeder is configured to feed a sheet. A leading end of the sheet in a feeding direction is to contact the contact member. The movement restricting member is configured to lock the contact member to restrict movement of the contact member from a contact position where the contact member contacts the sheet. The moving mechanism is configured to move the movement restricting member between a locking position and a lock releasing position. The contact member is configured to take the contact position by gravity or a biasing force of a biasing part. The control circuitry is configured to control the moving mechanism to move the movement restricting member to the lock releasing position and then to the locking position when a feeding operation of the sheet is finished.

10 Claims, 14 Drawing Sheets

(51) Int. Cl.
*B65H 5/26* (2006.01)
*B65H 3/56* (2006.01)

(56) References Cited

U.S. PATENT DOCUMENTS

| | | | | |
|---|---|---|---|---|
| 6,598,873 | B2 | 7/2003 | Takisawa et al. | |
| 8,118,299 | B2 * | 2/2012 | Sato | B65H 3/0684 271/118 |
| 2002/0033572 | A1 | 3/2002 | Takisawa et al. | |
| 2010/0133741 | A1 | 6/2010 | Sato | |
| 2010/0187754 | A1 | 7/2010 | Ubayashi | |
| 2012/0119436 | A1 | 5/2012 | Morita et al. | |
| 2012/0193863 | A1 | 8/2012 | Harada | |
| 2015/0115516 | A1 | 4/2015 | Satoh et al. | |
| 2015/0368056 | A1 * | 12/2015 | Murata | B65H 7/06 271/259 |
| 2016/0137446 | A1 | 5/2016 | Mizobe et al. | |
| 2016/0334748 | A1 | 11/2016 | Aoyama et al. | |
| 2016/0355358 | A1 | 12/2016 | Murakami et al. | |
| 2017/0283194 | A1 | 10/2017 | Nakagawa | |

FOREIGN PATENT DOCUMENTS

| | | | |
|---|---|---|---|
| CN | 101792072 | A | 8/2010 |
| CN | 102616588 | A | 8/2012 |
| CN | 106219273 | A | 12/2016 |
| CN | 107265147 | A | 10/2017 |
| EP | 2481694 | A2 | 8/2012 |
| JP | H08-310668 | A | 11/1996 |
| JP | 2005-247482 | | 9/2005 |
| JP | 2010-132383 | | 6/2010 |

* cited by examiner

SHEET FEEDING DEVICE AND IMAGE FORMING APPARATUS

CROSS-REFERENCE TO RELATED APPLICATIONS

This patent application is based on and claims priority pursuant to 35 U.S.C. § 119(a) to Japanese Patent Application No. 2018-219900, filed on Nov. 26, 2018, in the Japan Patent Office, the entire disclosure of which is hereby incorporated by reference herein.

BACKGROUND

Technical Field

The present disclosure relates to a sheet feeding device and an image forming apparatus.

Discussion of the Background Art

A sheet feeding device is conventionally known that includes a feeding unit which feeds a sheet, a contact member which a leading end of the sheet in a feeding direction contacts, a movement restricting member which locks the contact member and restricts movement of the contact member from a contact position in which the contact member contacts the sheet, and a moving mechanism which moves the movement restricting member between a locking position in which the contact member is locked and a lock releasing position in which the locking is released, in which the contact member takes the contact position by gravity or a biasing force of a biasing part.

For example, there is known a sheet feeding device in which a movement restricting member at a locking position is moved to a lock releasing position by a moving mechanism (solenoid), so that locking of a contact member by the movement restricting member is released, and the contact member becomes movable from a contact position.

SUMMARY

To solve the above-described problem, an aspect of the present disclosure, there is provided a sheet feeding device that includes a feeder, a contact member, a movement restricting member, a moving mechanism, and control circuitry. The feeder is configured to feed a sheet. A leading end of the sheet in a feeding direction is to contact the contact member. The movement restricting member is configured to lock the contact member to restrict movement of the contact member from a contact position where the contact member contacts the sheet. The moving mechanism is configured to move the movement restricting member between a locking position at which the movement restricting member locks the contact member and a lock releasing position at which the movement restricting member releases locking of the contact member. The contact member is configured to take the contact position by gravity or a biasing force of a biasing part. The control circuitry is configured to control the moving mechanism to move the movement restricting member to the lock releasing position and then to the locking position when a feeding operation of the sheet is finished.

In another aspect of the present disclosure, there is provided an image forming apparatus that includes an image forming device and the sheet feeding device. The image forming device is configured to form an image on a sheet-shaped recording medium. The sheet feeding device is configured to feed the recording medium toward the image forming device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
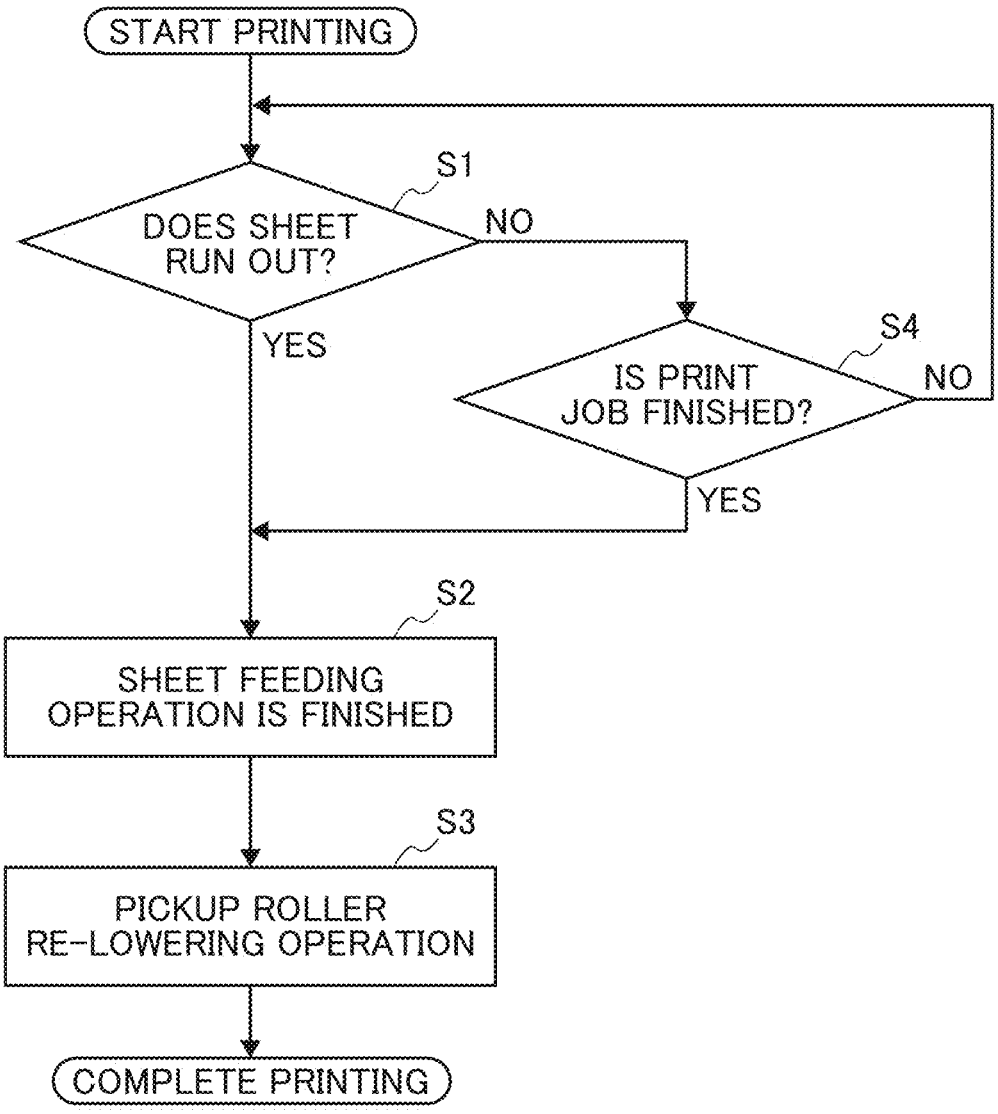
FIG. 1 is a flowchart illustrating an outline of a control flow of a sheet feeding device at the time of printing.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

An embodiment of an electrophotographic image forming apparatus to which the present invention is applied is hereinafter described.

Figure 2:
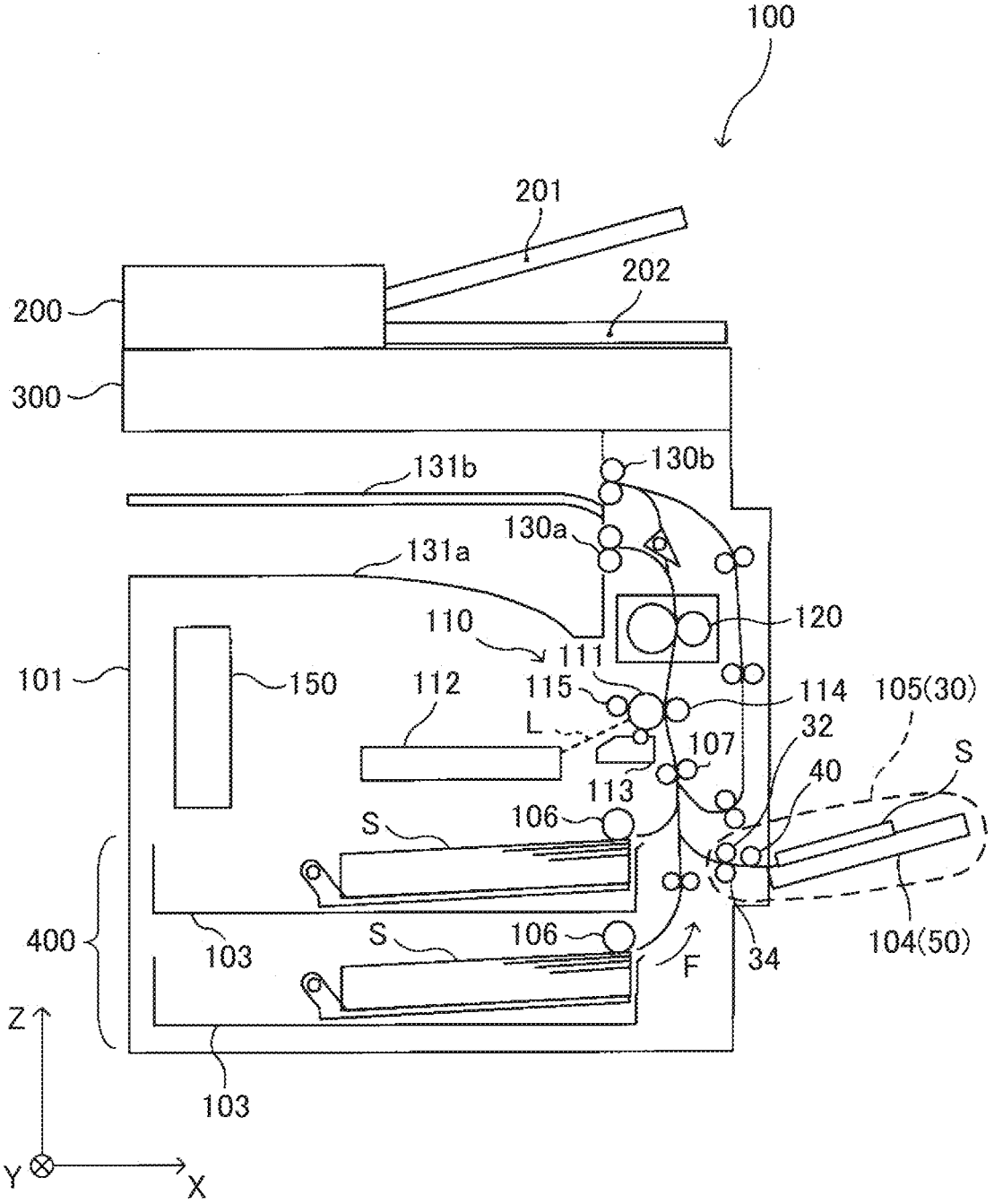
FIG. 2 is a schematic configuration diagram of a copier.

FIG. 2 is a schematic configuration diagram of a copier 100 being an image forming apparatus according to the embodiment.

The copier 100 illustrated in FIG. 2 includes an auto document feeder (ADF) 200 as an automatic document feeder, a scanner 300 as an image reading device, and a printer 101 which forms an image on a sheet of sheet S (hereinafter, sheet S). The scanner 300 reads an image of a sheet-shaped document conveyed by the ADF 200 and an image of a document placed on a contact glass of the scanner 300. The printer 101 forms an image on the sheet S based on image information input from an external device such as a personal computer or image information of the document read by the scanner 300.

In the printer 101, an image forming device 110 as a printer engine, a fixing device 120, and an optical writing device 112 are arranged. The printer 101 also includes an in-device sheet feeding unit 400 including an in-device sheet feed tray 103 which holds the sheet S in a stacked manner.

A manual sheet feeding device 105 including a manual sheet feed tray 104 on which manually fed sheet S is placed is further included on a right side in FIG. 2 of the printer 101.

An operation panel (operation display 3) being an input unit which inputs print information and the like is arranged on an upper part of the copier 100.

In the printer 101, a controller 150 which controls each unit of the copier 100 based on input information input from the external device such as the personal computer or the operation panel and detection information by a sensor is arranged.

Figure 3:
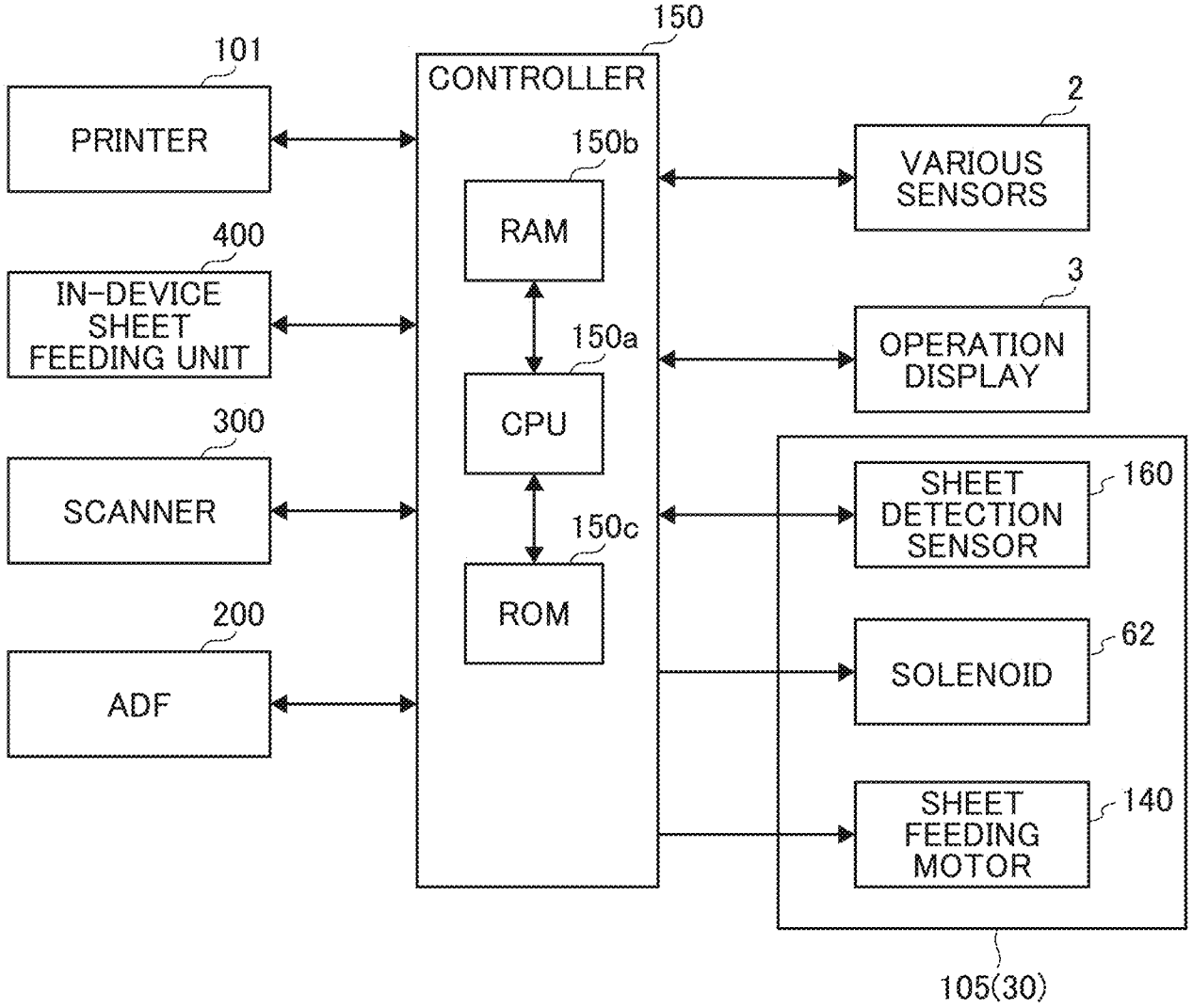
FIG. 3 is a block diagram illustrating a substantial part of the copier.

FIG. 3 is a block diagram illustrating a substantial part of the copier 100.

The copier 100 includes the controller 150 as control circuitry which controls an entire copier 100, and the controller 150 includes a central processing unit (CPU) 150*a* as an arithmetic unit and an information storage unit. The information storage unit includes a random access memory (RAM) 150*b*, a read-only memory (ROM) 150*c*, a hard disk drive (HDD) and the like for storing data. In this embodiment, for example, this includes the ROM 150*c* storing a system operating system (OS), various control programs required for copy, facsimile, and printer processes, page description language (PDL) processing system of the printer, initial setting values of the system and the like, the RAM 150*b* for a work memory and the like. The operation display 3 includes a display including a liquid crystal display and the like which displays character information and the like, an operation unit as an operation receiving unit which receives the input information from an operator through a numeric keypad and the like and sends the same to the controller 150 and the like.

A space is formed between the scanner 300 and the printer 101. On an upper part of the printer 101 located in this space, two stack units 131 (131*a* and 131*b*) on which the sheet S on which the image is formed by the printer 101 is ejected to be stacked are formed. A sheet conveyance path for conveying the sheet S from the in-device sheet feed tray 103 or the manual sheet feed tray 104 through the image forming device 110 to the fixing device 120 is formed. Arrow "F" in FIG. 2 indicates a conveyance direction of the sheet S.

The image forming device 110 includes a drum-shaped photoconductor 111 being an image bearer including a photosensitive layer on a surface thereof. The photoconductor 111 is rotatably supported by a side plate of the printer 101 and is rotationally driven in a counterclockwise direction in FIG. 2 by a driving source. Around the photoconductor 111, a charging roller 11 as a charging member, an irradiation exposure position of writing light L by the optical writing device 112, a developing device 113, a transfer roller 114 being a transfer member, a cleaning member and the like are sequentially arranged.

A surface of the charging roller 11 is in contact with a surface of the photoconductor 111, and when the photoconductor 111 rotates and a charging bias is applied to the charging roller 11, a uniform charge is supplied to the surface of the photoconductor 111. As a result, the surface of the photoconductor 111 is uniformly charged at a constant potential.

The optical writing device 112 irradiates the surface of the photoconductor 111 with laser light emitted from a laser diode as the writing light L based on the image information of the document read by the scanner 300 or the image information input from the external device to optically scan. By optically scanning the charged photoconductor 111, an electrostatic latent image is formed on the surface of the photoconductor 111.

The developing device 113 includes a developer carrier which faces the surface of the photoconductor 111 and supplies toner being a developer to the electrostatic latent image on the surface of the photoconductor 111, a developer concentration detecting unit, a pair of conveying screws as a developer conveying unit and the like. With such a configuration of the developing device 113, the electrostatic latent image on the surface of the photoconductor 111 is developed and a toner image is formed.

A surface of the rotatable transfer roller 114 contacts the surface of the photoconductor 111 to form a transfer nip, and a transfer bias is applied from a power supply for transfer bias to the transfer roller 114. The transfer roller 114 transfers the toner image on the surface of the photoconductor 111 to the sheet S conveyed to the transfer nip when the transfer bias is applied thereto.

On an upstream side of the transfer nip in a sheet conveyance direction, a registration roller pair 107 which controls a conveyance timing of the sheet S to the transfer nip is arranged.

When the sheet S fed from the in-device sheet feed tray 103 and the like and sent to the transfer nip by the registration roller pair 107 passes through the transfer nip, the toner image on the surface of the photoconductor 111 is transferred thereto. The sheet S to which the toner image is transferred is conveyed to the fixing device 120 where the toner image is melted by heat and pressure and the toner image is fixed on the sheet S. The sheet S after the toner image is fixed is sequentially ejected and stacked on the stack unit 131 (131*a* or 131*b*) by a sheet ejection roller pair 130 (130*a* or 130*b*) as an output image (copy).

The sheet S as a sheet placed on the manual sheet feed tray 104 of the manual sheet feeding device 105 is sent downstream in the sheet conveyance direction by a manual pickup roller (pickup roller 40). Only one sheet of sheet S is separated by a sheet feeding roller 32 and a separation roller 34 forming a manual separation mechanism being a separation feeder to separate the fed sheets one by one. The separated one sheet of sheet S is fed into the sheet conveyance path and sent to the registration roller pair 107.

The manual separation mechanism of this embodiment forms a separation nip of a pair of roller members (32 and 34). When a plurality of sheets of sheet S enters the separation nip, only an uppermost sheet of sheet S is fed downstream in a feeding direction and a conveyance force toward an upstream side in the feeding direction is applied to other sheets of sheet S. The manual separation mechanism is not limited to such a configuration. For example, other known configurations such as a configuration of forming the separation nip of a belt member and a roller member, a configuration of forming the separation nip of a roller which applies the conveyance force and a separation pad which suppresses movement in the conveyance direction and the like may be used.

The sheet feeding device in the copier 100 includes the in-device sheet feed tray 103 for accommodating standard-size sheet S in a main body of the printer 101. The printer 101 further includes the manual sheet feeding device 105 for printing on a sheet of a size which cannot be accommodated in the in-device sheet feed tray 103 or a small number of sheets of sheet S. The manual sheet feeding device 105 includes the manual sheet feed tray 104 on which the sheet S is manually placed, and feeds and conveys the sheet S from the manual sheet feed tray 104.

A configuration of a sheet feeding device 30 applicable to the manual sheet feeding device 105 in this embodiment is next described.

Figure 4:
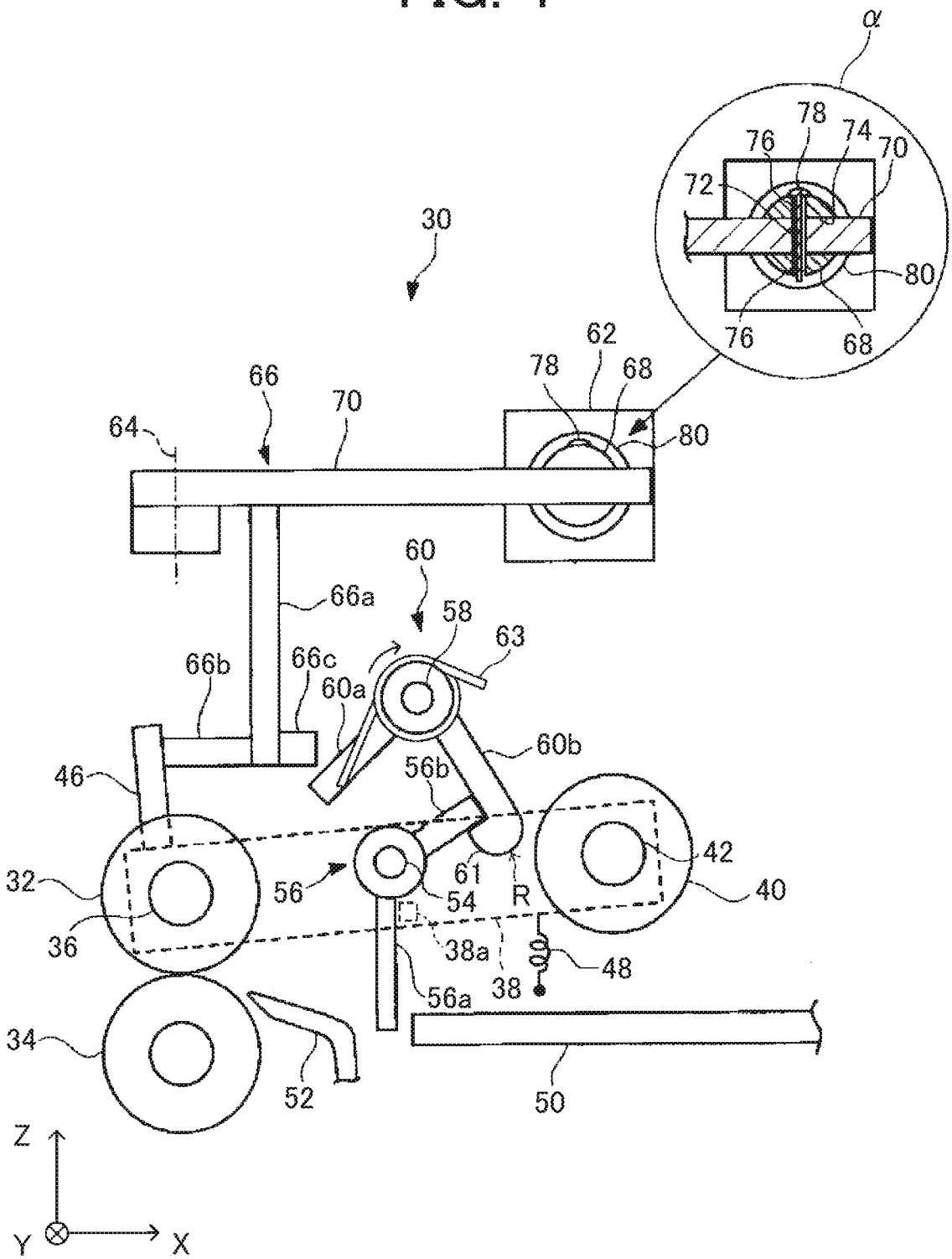
FIG. 4 is an enlarged side view of the sheet feeding device.
Figure 5:
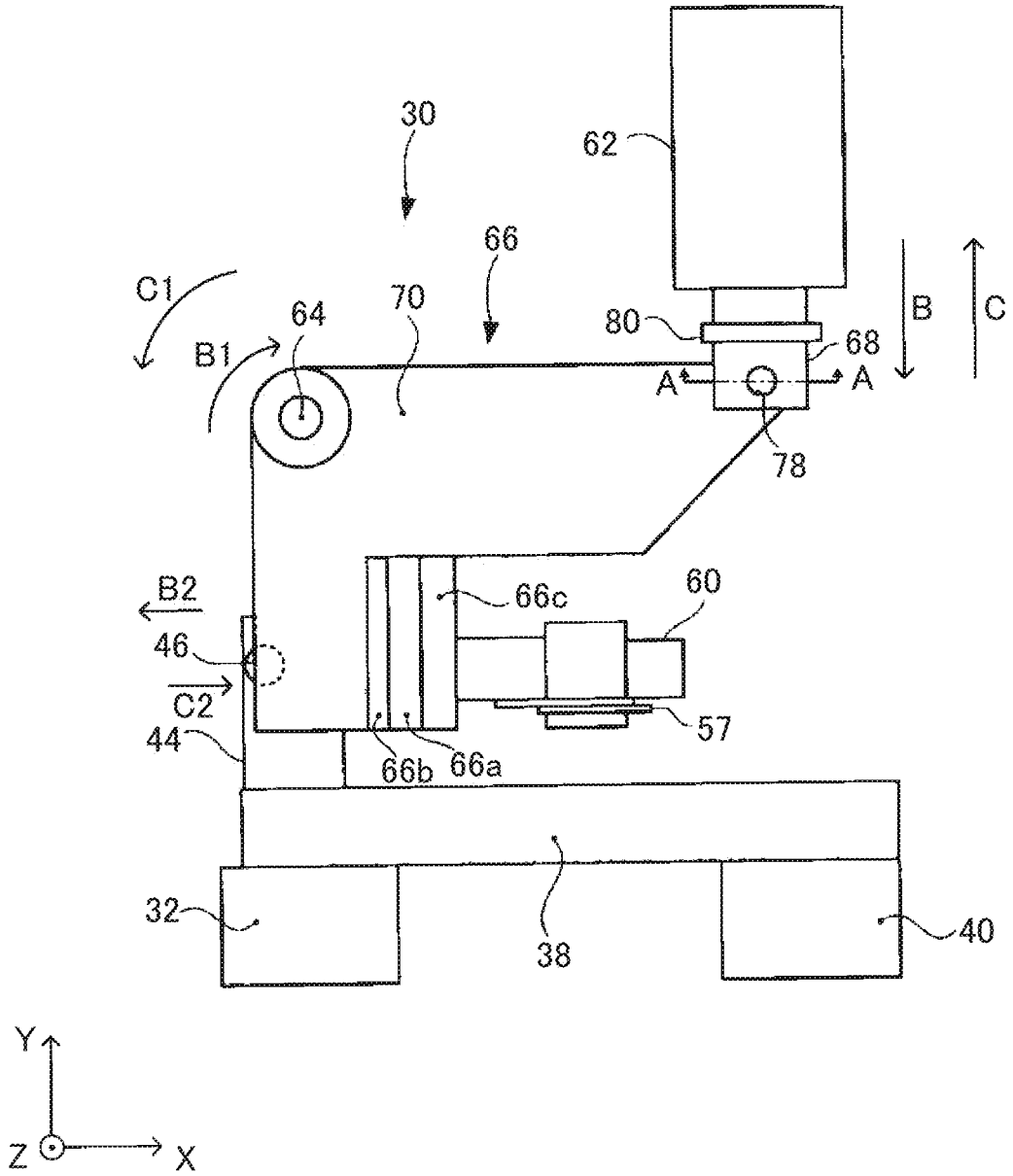
FIG. 5 is a top view of the sheet feeding device.

FIG. 4 is an enlarged side view of the sheet feeding device 30. FIG. 5 is a top view of the sheet feeding device 30 illustrated in FIG. 4. A partial cross-sectional view "a" in FIG. 4 is a cross-sectional view taken along line A-A in FIG. 5.

The sheet feeding device 30 includes the sheet feeding roller 32 and the separation roller 34. A pickup arm 38 one end of which is supported by a sheet feeding roller shaft 36 being a rotary shaft of the sheet feeding roller 32 which rotates about the sheet feeding roller shaft 36 is also provided. On the other end of the pickup arm 38, a pickup roller shaft 42 is arranged, and the pickup roller 40 is rotatably supported with respect to the pickup roller shaft 42.

The pickup roller 40 is coupled to the sheet feeding roller 32 via a plurality of drive transmission gears. The controller 150 illustrated in the block diagram of FIG. 3 drives a sheet feeding motor 140, so that the sheet feeding roller 32 illustrated in FIGS. 4 and 5 rotates, and the pickup roller 40 also rotates along with the rotation of the sheet feeding roller 32.

The pickup arm 38 includes a contact arm holding unit 44 projecting in a horizontal direction (Y-axis direction) on one end thereof, and a contact arm 46 is fixed to an upper part of the contact arm holding unit 44.

Figure 6:
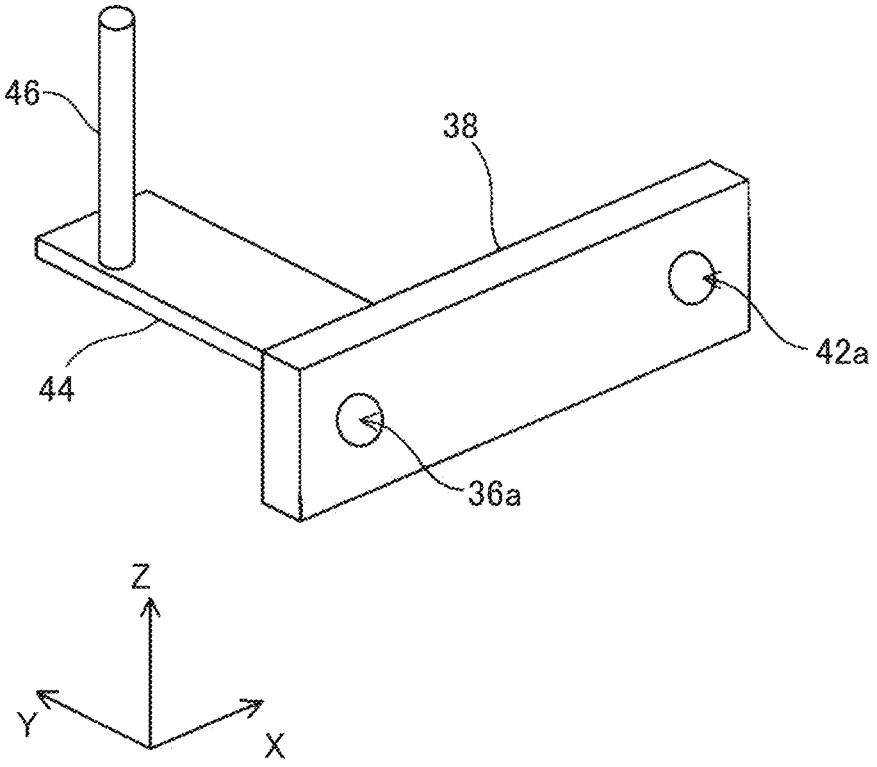
FIG. 6 is a schematic perspective view of a pickup arm, a contact arm holding unit, and a contact arm.

FIG. 6 is a schematic perspective view of the pickup arm 38, the contact arm holding unit 44, and the contact arm 46. In FIG. 6, reference signs "36*a*" and "42*a*" represent shaft insertion holes provided on the pickup arm 38, the reference sign "36*a*" representing a hole into which the sheet feeding roller shaft 36 is inserted, and the reference sign "42*a*" representing a hole into which the pickup roller shaft 42 is inserted.

The pickup arm 38, the sheet feeding roller shaft 36, and the pickup roller shaft 42 are not limited to have a configuration obtained by combining separate parts via the shaft insertion holes, and an integrated configuration in which the pickup arm 38 has functions of the sheet feeding roller shaft 36 and the pickup roller shaft 42 may also be used.

In FIG. 4, the pickup arm 38 is indicated by a broken line in order to facilitate understanding of the structure. The pickup arm 38 is biased by a coil spring 48 being a biasing member so that the other end side (right side in FIGS. 4 and 5) rotates downward. The biasing member is not limited to the coil spring, and other springs may also be used.

Below the pickup roller 40, a sheet feed tray 50 is provided. In FIG. 5, the sheet feed tray 50 is not illustrated for convenience in order to simplify the drawing. On a downstream side in a sheet conveyance direction of the sheet feed tray 50 (sheet passing direction, left side in FIGS. 4 and 5), a conveyance guide 52 for guiding the sheet S conveyed from the sheet feed tray 50 to the separation nip where the sheet feeding roller 32 contacts the separation roller 34 is provided.

As illustrated in FIG. 3, the controller 150 is electrically connected to a sheet detection sensor 160, a solenoid 62, and the sheet feeding motor 140 included in the sheet feeding device 30 to control operation of each of them. The sheet detection sensor 160 is a sensor which detects presence or absence of the sheet S on the sheet feed tray 50.

Above a portion between the sheet feed tray 50 and the conveyance guide 52, a sheet stopper 56 rotatably supported by a stopper shaft 54 fixed to a housing of the sheet feeding device 30 is provided. The sheet stopper 56 includes a stopper first arm 56*a* and a stopper second arm 56*b* extending in a direction (direction parallel to a Z-X plane) perpendicular to a longitudinal direction (Y-axis direction) of the stopper shaft 54.

As illustrated in FIG. 4, above the sheet stopper 56, a sheet stopper rotation restricting member 60 rotatably supported by a restricting member shaft 58 fixed to the housing of the sheet feeding device is provided. The sheet stopper rotation restricting member 60 includes a restricting member first arm 60*a* and a restricting member second arm 60*b* extending in a direction perpendicular to a longitudinal direction of the restricting member shaft 58. On a tip end of the restricting member second arm 60*b*, a stopper locking projection 61 is provided so as to be able to lock the stopper second arm 56*b* of the sheet stopper 56, and on an outer surface of the stopper locking projection 61, a curved surface R is formed.

The pickup arm 38 includes a stopper locking unit 38*a* so that rotation in the counterclockwise direction in FIG. 4 of the sheet stopper 56 stops at a position illustrated in FIG. 4. The position of the sheet stopper 56 in a state illustrated in FIG. 4 is a position where the stopper first arm 56*a* stands by to stop a leading end of the sheet S when a bundle of sheet S is thrown into the sheet feed tray 50 (this position is hereinafter referred to as a standby position). That is, even if the sheet stopper 56 is about to rotate in the counterclockwise direction in FIG. 4, the stopper first arm 56*a* contacts the stopper locking unit 38*a* and the sheet stopper 56 stops at the standby position.

The sheet stopper rotation restricting member 60 is biased to rotate in a direction (clockwise direction) indicated by arrow in FIG. 4 by a restricting member biasing torsion spring 63 which is a biasing member. The biasing member which biases the sheet stopper rotation restricting member 60 to rotate is not limited to a torsion spring such as the restricting member biasing torsion spring 63, and an elastic member such as another spring may also be used.

The sheet feeding device 30 further includes the solenoid 62 and a solenoid link 66 rotatably supported by a link support shaft 64 fixed to the housing of the sheet feeding device 30.

The solenoid link 66 includes a plate-shaped coupling member 70 coupled to a movable iron core 68 of the solenoid 62. The plate-shaped coupling member 70 is a plate-shaped member extending in the horizontal direction (direction parallel to an X-Y plane) rotatably supported by the link support shaft 64 an axial direction of which is a vertical direction (Z-axis direction).

The solenoid link 66 includes a link first arm 66*a*, a link second arm 66*b*, and a link third arm 66*c*. The link first arm 66*a* is a member extending vertically downward (negative Z-axis direction) from the plate-shaped coupling member 70. The link second arm 66*b* and the link third arm 66*c* are fixed to a lower end of the link first arm 66*a* and extend toward both sides in an X-axis direction (right and left directions in FIGS. 4 and 5) of the link first arm 66*a* across the link first arm 66*a*.

A tip end of the link second arm 66*b* (end in a negative X-axis direction, end to the left in FIGS. 4 and 5) is arranged so as to be able to contact the contact arm 46 fixed to the pickup arm 38. A tip end of the link third arm 66*c* (end in a positive X-axis direction, end to the right in FIGS. 4 and 5) is arranged so as to be able to contact the restricting member first arm 60*a* of the sheet stopper rotation restricting member 60.

The plate-shaped coupling member 70 of the solenoid link 66 is coupled to the movable iron core 68 of the solenoid 62 with a following structure. That is, as illustrated in the partial cross-sectional view "a" in FIG. 4 (cross-sectional view taken along line A-A in FIG. 5), on an end in the positive X-axis direction of the plate-shaped coupling member 70, a coupling member through hole 72 formed so as to penetrate the plate-shaped coupling member 70 vertically (Z-axis direction) is provided.

The end of the plate-shaped coupling member 70 is fitted into an iron core tip end groove 74 cut in the horizontal direction at a tip end of the movable iron core 68 (end in a negative Y-axis direction, front end in FIG. 4, lower end in FIG. 5). In a portion of the movable iron core 68 where the iron core tip end groove 74 is formed, an iron core through hole 76 formed so as to penetrate the movable iron core 68 in the vertical direction (Z-axis direction) across the iron core tip end groove 74 is provided.

The plate-shaped coupling member 70 is fitted into the iron core tip end groove 74 of the movable iron core 68, and in a state in which the iron core through hole 76 of the movable iron core 68 and the coupling member through hole 72 of the plate-shaped coupling member 70 overlap with each other, the coupling pin 78 is inserted into the iron core through hole 76 from an upper part of the movable iron core 68. As a result, the coupling pin 78 inserted into the iron core through hole 76 passes through the coupling member through hole 72, and the plate-shaped coupling member 70 and the movable iron core 68 are coupled to each other.

Inner diameters of the coupling member through hole 72 and the iron core through hole 76 and an outer diameter of the coupling pin 78 are determined so that a gap is formed between the coupling member through hole 72 and iron core through hole 76 and the coupling pin 78. This allows the solenoid link 66 to rotate when the movable iron core 68 linearly moves in a direction of movement by the solenoid 62 (Y-axis direction, front-rear direction in FIG. 4, and up-down direction in FIG. 5).

As illustrated in FIGS. 4 and 5, a flange-shaped iron core stopper 80 is provided so as to surround an outer circumference of the movable iron core 68. The iron core stopper 80 serves to stop the linear movement of the movable iron core 68 when the controller 150 turns the solenoid 62 "ON" and the movable iron core 68 is drawn in. Although not illustrated in the drawing, a stopper is also provided for stopping the linear movement of the movable iron core 68 when the solenoid 62 is turned "OFF" and the movable iron core 68 is pushed out.

A series of sheet feeding operations in the sheet feeding device 30 is next described with reference to FIGS. 7 to 11. In enlarged side views of the sheet feeding device 30 illustrated in FIGS. 7 to 11, the coil spring 48, the restricting member biasing torsion spring 63, and the stopper locking unit 38*a* illustrated in FIG. 4 are omitted for convenience.

Figure 7:
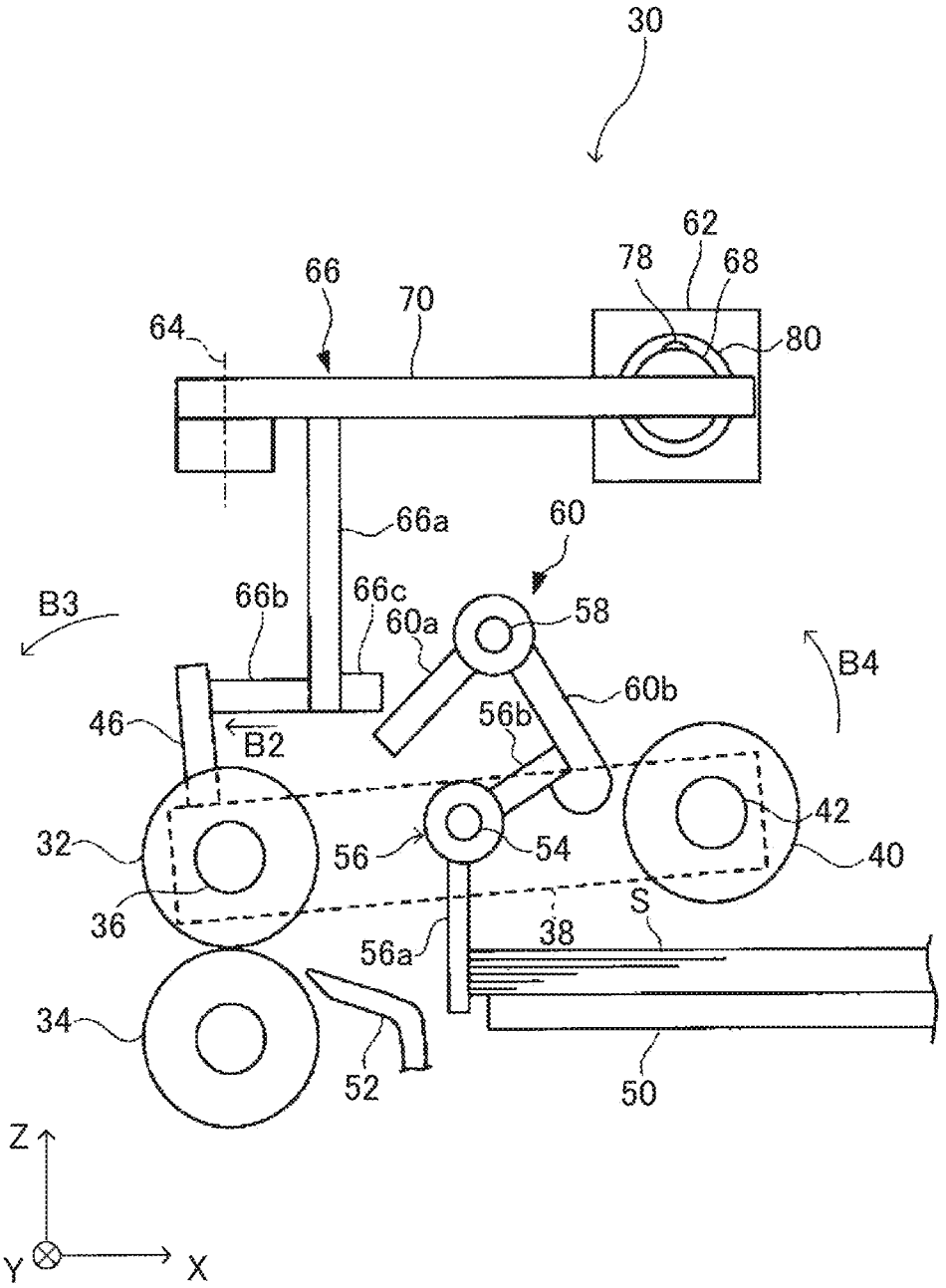
FIG. 7 is a side view of the sheet feeding device in a state in which a sheet feeding operation is stopped.

FIG. 7 is a side view of the sheet feeding device 30 in a state in which the sheet feeding operation is stopped.

When the sheet feeding operation is stopped, the solenoid 62 is in the "OFF" state, and as illustrated in FIGS. 4 and 5, the movable iron core 68 is in a pushed out state (state pushed out in arrow "B" direction in FIG. 5). At that time, the solenoid link 66 is rotated in the clockwise direction in FIG. 5 about the link support shaft 64 (arrow "B1" direction in FIG. 5). An end of the solenoid link 66 on a side in a negative Y-axis direction (the lower side in FIG. 5 and the front side in a direction perpendicular to a sheet surface in FIG. 7) moves in a direction indicated by arrow "B2" in FIGS. 5 and 7.

In this state, the link second arm 66*b* of the solenoid link 66 moves in the direction indicated by arrow "B2" in FIGS. 5 and 7 and presses the contact arm 46 fixed to the pickup arm 38 to the left in FIG. 7. By this pressing, the contact arm 46 rotates about the sheet feeding roller shaft 36 in the counterclockwise direction indicated by arrow "B3" in FIG. 7, and the pickup arm 38 to one end of which the contact arm 46 is fixed also rotates in the counterclockwise direction about the sheet feeding roller shaft 36. By this rotation, the other end side of the pickup arm 38 rotates so as to move upward as indicated by arrow "B4" in FIG. 7, and as a result, the pickup roller 40 rotatably supported on the other end side of the pickup arm 38 is raised.

In this state, the sheet stopper 56 is at the standby position described above, and the stopper second arm 56*b* thereof is locked by the restricting member second arm 60*b* of the sheet stopper rotation restricting member 60. Therefore, the rotation of the sheet stopper 56 in the clockwise direction in FIG. 7 is restricted, and the rotation of the sheet stopper 56 so that the stopper first arm 56*a* of the sheet stopper 56 moves to the left than the state illustrated in FIG. 7, that is, in the sheet feeding direction is restricted. In this state, when the bundle of sheet S is placed on the sheet feed tray 50 so as to stick the bundle of sheet S in the sheet feeding direction, the leading end of the bundle of sheet S contacts the stopper first arm 56*a* of the sheet stopper 56 and the bundle of sheet S stops. Therefore, it is possible to prevent the sheet S from being pushed in the separation nip formed of the sheet feeding roller 32 and the separation roller 34.

When the bundle of sheet S placed on the sheet feed tray 50 is roundly inserted toward the separation nip with a human hand, more sheets of sheet S than the maximum number of sheets of sheet S expected to reach the separation nip might reach the separation nip at the time of sheet feeding. If the sheet is fed in this state, the sheet S cannot be completely separated at the separation nip, and multiple feeding that a plurality of sheets of sheet S is fed to the sheet conveyance path in the printer 101 might occur. If the bundle of sheet S is inserted into the separation nip with a human hand in an inclined state, skewing might occur.

When the bundle of sheet S is roundly inserted toward the separation nip with a human hand, the leading end of the bundle of sheet S might be bent by the sheet feeding roller 32 or the separation roller 34, thereby causing deterioration in print quality or sheet jam during printing.

In contrast, in the sheet feeding device 30 of this embodiment, even if the bundle of sheet S placed on the sheet feed tray 50 is to be manually inserted into the separation nip, the sheet stopper 56 contacts the bundle of sheet S and it is possible to prevent the bundle of sheet S from being manually inserted into the separation nip. Therefore, it is possible to prevent the above-described multiple feeding, deterioration in print quality, and sheet jam during printing. By aligning a position of the leading end of the sheet S with the sheet stopper 56, occurrence of skewing may also be prevented.

Figure 8:
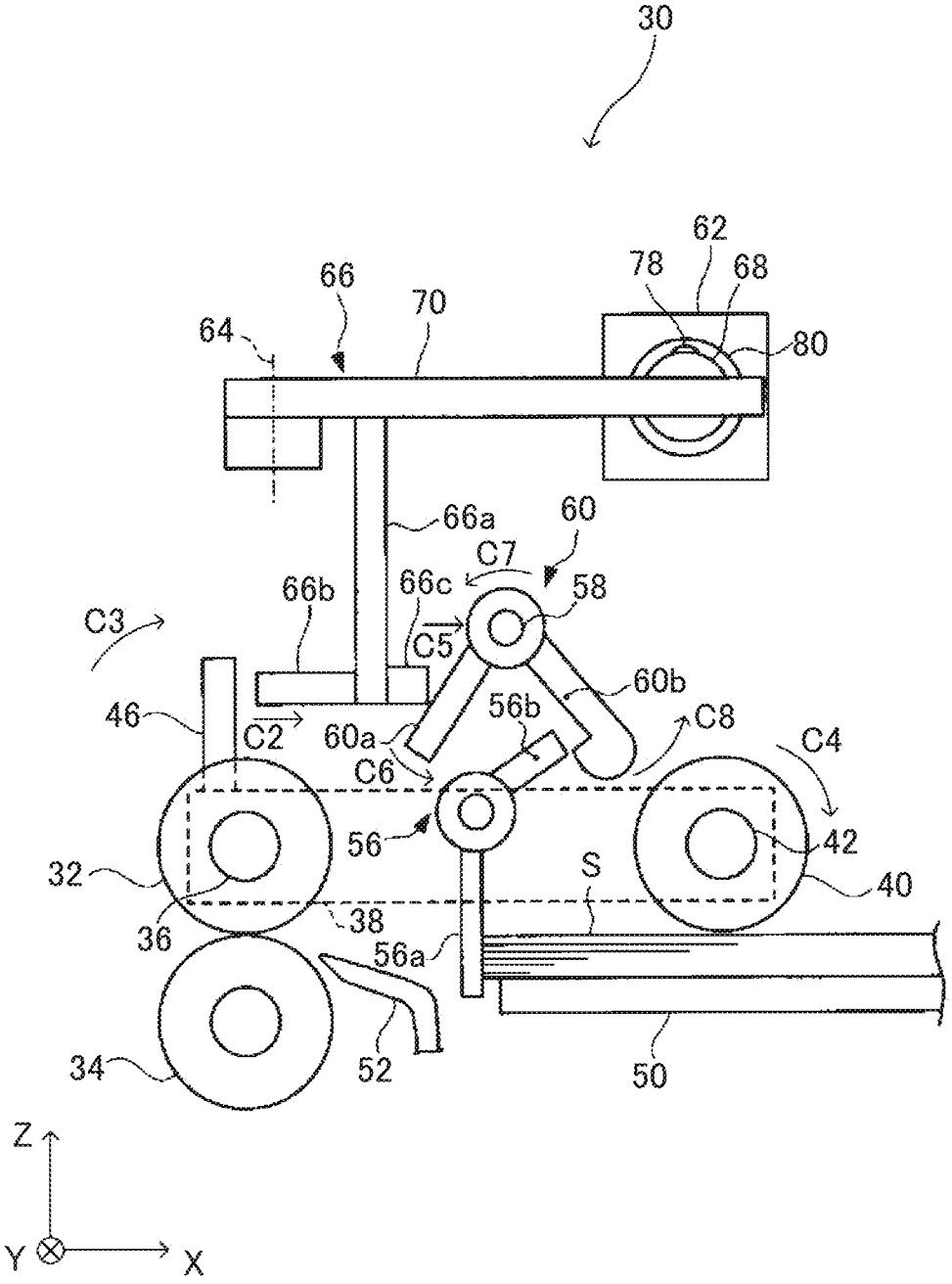
FIG. 8 is a side view of the sheet feeding device in a state in which the sheet feeding operation is started.

FIG. 8 is a side view of the sheet feeding device 30 in a state in which the sheet feeding operation is started.

When the sheet feeding operation is started, prior to the sheet feeding operation, the controller 150 starts driving the sheet feeding motor 140 and the sheet feeding roller 32 rotates in the clockwise direction in FIG. 8. As the sheet feeding roller 32 rotates, the driving is transmitted to the pickup roller 40 via the drive transmission gear described above, and the pickup roller 40 rotates in the clockwise direction in FIG. 8. The separation roller 34 a surface of which is in contact with a surface of the sheet feeding roller 32 rotates in the counterclockwise direction in FIG. 8 together with the rotation of the sheet feeding roller 32.

Then, the controller 150 turns the solenoid 62 "ON", so that the movable iron core 68 is drawn into the solenoid 62 (drawn in a direction of arrow "C" in FIG. 5 and in depth in a direction perpendicular to a sheet surface in FIG. 8). At that time, the solenoid link 66 is rotated in the counterclockwise direction in FIG. 5 about the link support shaft 64 (the direction of arrow "C1" in FIG. 5). By the rotation of the solenoid link 66, the end on the side in the negative Y-axis direction of the solenoid link 66 (the lower side in FIG. 5 and the front side in a direction perpendicular to a sheet surface in FIG. 8) moves in a direction indicated by arrow "C2" in FIGS. 5 and 8. By this movement, the link third arm 66*c* of the solenoid link 66 moves in a direction of arrow "C5" in FIG. 8 and presses the restricting member first arm 60*a* to the right in FIG. 8.

By this pressing, the restricting member first arm 60*a* moves in a direction indicated by arrow "C6" in FIG. 8, and the sheet stopper rotation restricting member 60 rotates in the counterclockwise direction in FIG. 8 (direction of arrow "C7" in FIG. 8) about the restricting member shaft 58. By this rotation, the restricting member second arm 60*b* of the sheet stopper rotation restricting member 60 moves in a direction of arrow "C8" in FIG. 8, and locking of the stopper second arm 56*b* of the sheet stopper 56 by the restricting member second arm 60*b* is released. Then, the restriction of the rotation of the sheet stopper 56 in the clockwise direction in FIG. 8 is released. As a result, the restriction of the rotation of the sheet stopper 56 so that the stopper first arm 56*a* of the sheet stopper 56 moves to the left, that is, in the sheet feeding direction from the state illustrated in FIG. 8 is released.

Simultaneously with such operation, the link second arm 66*b* of the solenoid link 66 moves in the direction of arrow "C2" in FIG. 8 by the above-described rotation of the solenoid link 66. As a result, the link second arm 66*b* separates from the contact arm 46 fixed to the pickup arm 38 and the contact is released, and the contact arm 46 may move in the clockwise direction in FIG. 8. The pickup arm 38 is biased by the coil spring 48 (refer to FIG. 4) so as to rotate in the clockwise direction in FIG. 8. Therefore, when the contact of the link second arm 66*b* with the contact arm 46 is released, the pickup arm 38 rotates in the clockwise direction in FIG. 8 about the sheet feeding roller shaft 36 so that the contact arm 46 moves in the direction of arrow "C3" in FIG. 8. By this rotation, the other end side of the pickup arm 38 rotates so as to move downward as indicated by arrow "C4" in FIG. 8, and as a result, the pickup roller 40 rotatably supported on the other end side of the pickup arm 38 is lowered. Then, the pickup roller 40 in a state rotating in the clockwise direction in FIG. 8 contacts the uppermost sheet S on the sheet feed tray 50, and the conveyance force in the conveyance direction (leftward in FIG. 8) is assigned to the sheet S.

Figure 9:
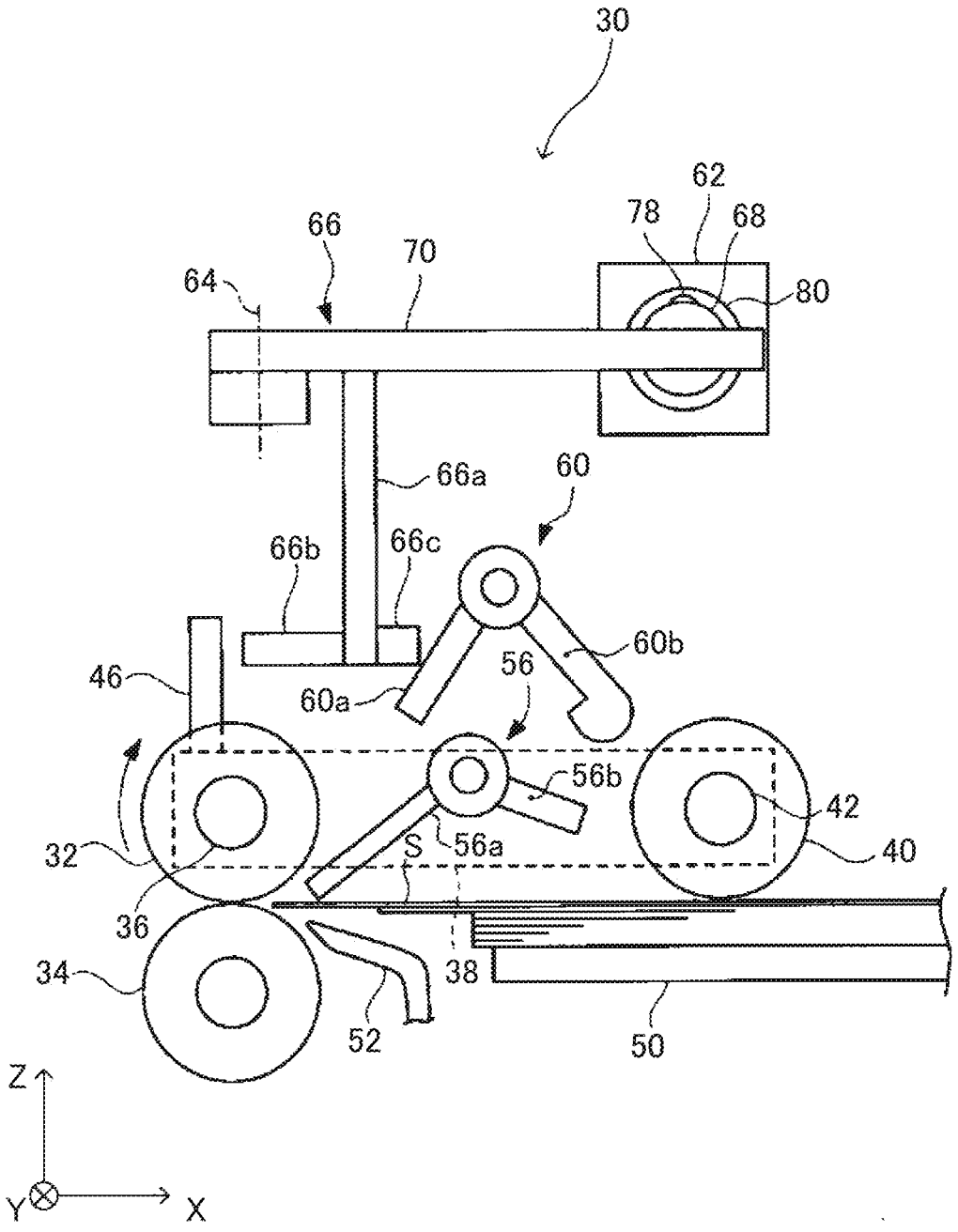
FIG. 9 is a side view of the sheet feeding device in a state immediately after a sheet on a sheet feed tray is delivered.
Figure 10:
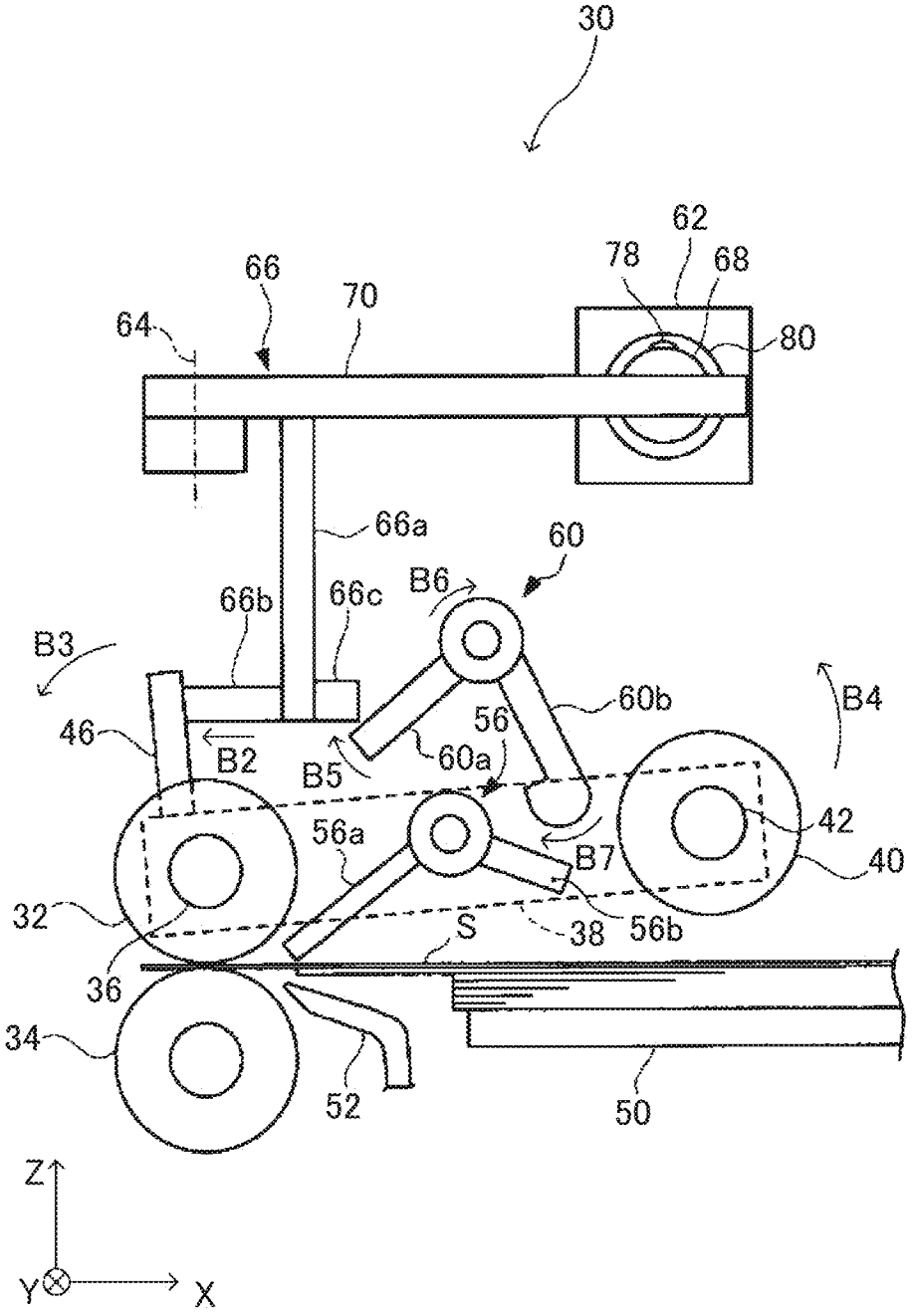
FIG. 10 is a side view of the sheet feeding device in a state immediately after the delivered sheet reaches a separation nip.

FIG. 9 is a side view of the sheet feeding device 30 in a state immediately after the sheet S on the sheet feed tray 50 is delivered. FIG. 10 is a side view of the sheet feeding device 30 in a state immediately after the delivered sheet S reaches the separation nip.

As illustrated in FIG. 9, the uppermost sheet S on the sheet feed tray 50 is delivered from the sheet feed tray 50 by the pickup roller 40 and conveyed toward the separation nip where the sheet feeding roller 32 and the separation roller 34 are in contact with each other.

The leading end of the sheet S contacts the stopper first arm 56*a* of the sheet stopper 56 in the middle of the conveyance, but as described above with reference to FIG. 8, the restriction of the rotation of the sheet stopper 56 in the clockwise direction in FIG. 9 is released. Therefore, when the conveyed sheet S pushes the stopper first arm 56*a*, the sheet stopper 56 rotates in the clockwise direction in FIG. 9, and the sheet S passes through a restriction position by the sheet stopper 56 to be conveyed toward the separation nip where the sheet feeding roller 32 and the separation roller 34 are in contact with each other.

At a predetermined timing before a trailing edge of the sheet S passes through the pickup roller 40, the controller 150 turns the solenoid 62 "OFF", so that the movable iron core 68 is pushed out by the solenoid 62 and a coupling portion between the movable iron core 68 and the plate-shaped coupling member 70 moves in the direction of arrow "B" in FIG. 5. As a result, the solenoid link 66 rotates in the clockwise direction in FIG. 5 (direction of arrow "B1" in FIG. 5). By this rotation, the end on the side in the negative Y-axis direction of the solenoid link 66 (the lower side in FIG. 5 and the front side in a direction perpendicular to a sheet surface in FIGS. 9 and 10) moves in the direction indicated by arrow "B2" in FIGS. 5 and 10.

By this movement, the link second arm 66*b* of the solenoid link 66 presses the contact arm 46 fixed to the pickup arm 38 to the left in FIG. 10. By this pressing, the contact arm 46 rotates about the sheet feeding roller shaft 36 in the counterclockwise direction indicated by arrow "B3" in FIG. 10, and the pickup arm 38 on one end side of which the contact arm 46 is fixed also rotates in the counterclockwise direction about the sheet feeding roller shaft 36. By this rotation, the other end side of the pickup arm 38 rotates so as to move upward as indicated by arrow "B4" in FIG. 10, and as a result, the pickup roller 40 rotatably supported on the other end side of the pickup arm 38 is raised.

After the pickup roller 40 is raised, the sheet S is conveyed by the sheet feeding roller 32 and the separation roller 34.

By the movement of the solenoid link 66 described above, the link third arm 66*c* of the solenoid link 66 moves in the direction of arrow "B2" in FIG. 10. Therefore, the pressing of the link third arm 66*c* against the restricting member first arm 60*a* of the sheet stopper rotation restricting member 60 is released, and the link third arm 66*c* becomes movable in a direction of arrow "B5" in FIG. 10. As a result, the sheet stopper rotation restricting member 60 becomes rotatable in the clockwise direction in FIG. 10.

Since the sheet stopper rotation restricting member 60 becomes rotatable in the clockwise direction, this rotates in the clockwise direction in FIG. 10 (direction of arrow "B6" in FIG. 10) by inertia moment of its own weight and the biasing force of the restricting member biasing torsion spring 63 (refer to FIG. 4). At that time, the sheet stopper rotation restricting member 60 rotates to a position where the restricting member first arm 60*a* contacts the link third arm 66*c* of the solenoid link 66. That is, when the link third arm 66*c* moves in the direction of arrow "B2" in FIG. 10, the sheet stopper rotation restricting member 60 rotates in conjunction with the movement of the restricting member first arm 60*a* in a state in which the contact state between the restricting member first arm 60*a* and the link third arm 66*c* is maintained.

At a predetermined timing after the trailing edge of the sheet S passes through the separation nip, the controller 150 turns the solenoid 62 "ON". As a result, the link second arm 66*b* of the solenoid link 66 separates from the contact arm 46 fixed to the pickup arm 38, and the sheet feeding device 30 returns to the state illustrated in FIG. 9. Then, the next sheet S is delivered from the sheet feed tray 50. Thereafter, by repeating the operation similar to that described with reference to FIGS. 9 and 10, the sheet S is sequentially delivered from the sheet feed tray 50 to be conveyed to the separation nip where the sheet feeding roller 32 contacts the separation roller 34.

Figure 11:
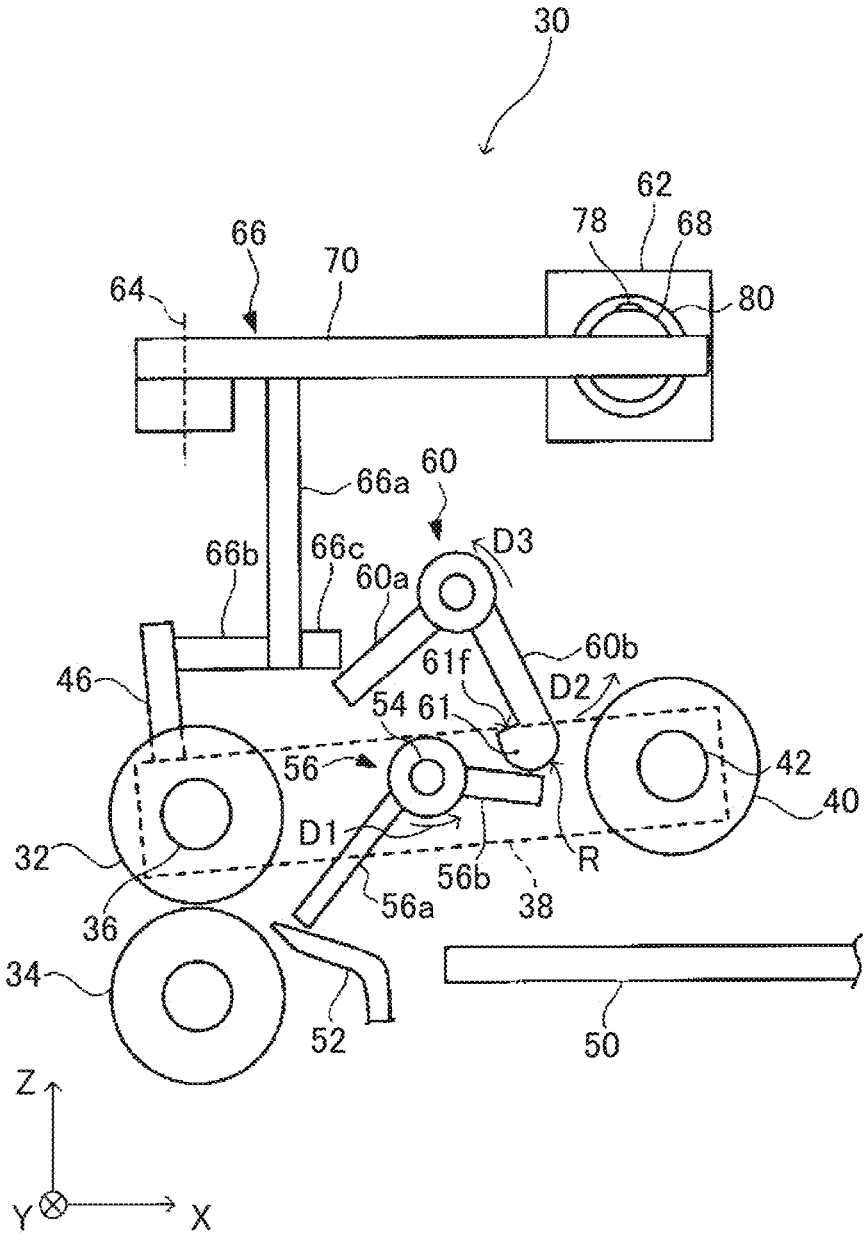
FIG. 11 is a side view of the sheet feeding device in a state in which the sheet feeding operation is finished.

FIG. 11 is a side view of the sheet feeding device 30 in a state in which the sheet feeding operation is finished.

When the printing of the image information from the external device or the copying of the document is finished, or when the sheet S in the sheet feed tray 50 runs out, the sheet feeding operation is stopped.

FIG. 11 illustrates a state in which the last sheet S is sent from the separation nip which is a contact portion between the sheet feeding roller 32 and the separation roller 34 and the sheet feed tray 50 becomes empty. When the last sheet S is sent from the separation nip, the controller 150 stops driving the sheet feeding motor 140, and the rotation of the sheet feeding roller 32, the separation roller 34, and the pickup roller 40 is stopped.

The controller 150 determines whether or not the last sheet S is sent from the separation nip as follows. That is, when the conveyance of the next sheet starts at a predetermined timing after the trailing edge of the sheet S passes through the separation nip, when the sheet detection sensor 160 detects that there is no sheet S on the sheet feed tray 50, it is determined that the last sheet S on the sheet feed tray 50 is sent from the separation nip.

In a state in which the sheet S on the sheet feed tray 50 is conveyed as illustrated in FIGS. 9 and 10, if the stopper first arm 56*a* moved downstream in the conveyance direction by the sheet S is about to return to the standby position by its own weight, this contacts the sheet S and does not return to the standby position. In contrast, in a state in which the last sheet S is sent, the sheet stopper 56 rotates in the counterclockwise direction in FIG. 11 about the stopper shaft 54 (direction of arrow "D I" in FIG. 11) so as to return to the standby position by the inertia moment of the weight of the stopper first arm 56*a*.

When the sheet stopper 56 rotates in this manner, the stopper second arm 56*b* of the sheet stopper 56 contacts the curved surface R of the stopper locking projection 61 on the tip end of the restricting member second arm 60*b* of the sheet stopper rotation restricting member 60.

By the inertia moment by the weight of the sheet stopper 56, the stopper second arm 56*b* pushes up the stopper locking projection 61 from below. As a result, the sheet stopper rotation restricting member 60 rotates in the counterclockwise direction in FIG. 11 (direction of arrow "D3" in FIG. 11) so that the pushed-up restricting member second arm 60*b* moves in the direction of arrow "D2" in FIG. 11.

By this rotation, a position on the curved surface R in contact with the stopper second arm 56*b* moves, and when this passes an end on a left side in FIG. 11 of the curved surface R, the pushing-up of the stopper locking projection 61 by the stopper second arm 56*b* disappears.

As a result, the sheet stopper rotation restricting member 60 rotates in the clockwise direction in FIG. 11 (direction opposite to arrow "D3" in FIG. 11), and the tip end of the stopper second arm 56*b* gets caught on a locking surface 61*f* of the stopper locking projection 61 to return to the state illustrated in FIG. 4.

When the stopper second arm 56*b* pushes up the restricting member second arm 60*b*, the sheet stopper 56 is rotated in the counterclockwise direction in FIG. 11 so that the contact position of the stopper second arm 56*b* moves along the curved surface R of the stopper locking projection 61 against frictional resistance. Therefore, the rotation of the sheet stopper 56 and the sheet stopper rotation restricting member 60 sometimes stops in an equilibrium state in which the inertia force by the inertia moment by the weight of the sheet stopper 56 and a force which prevents the movement by the frictional resistance described above are balanced.

Figure 12:
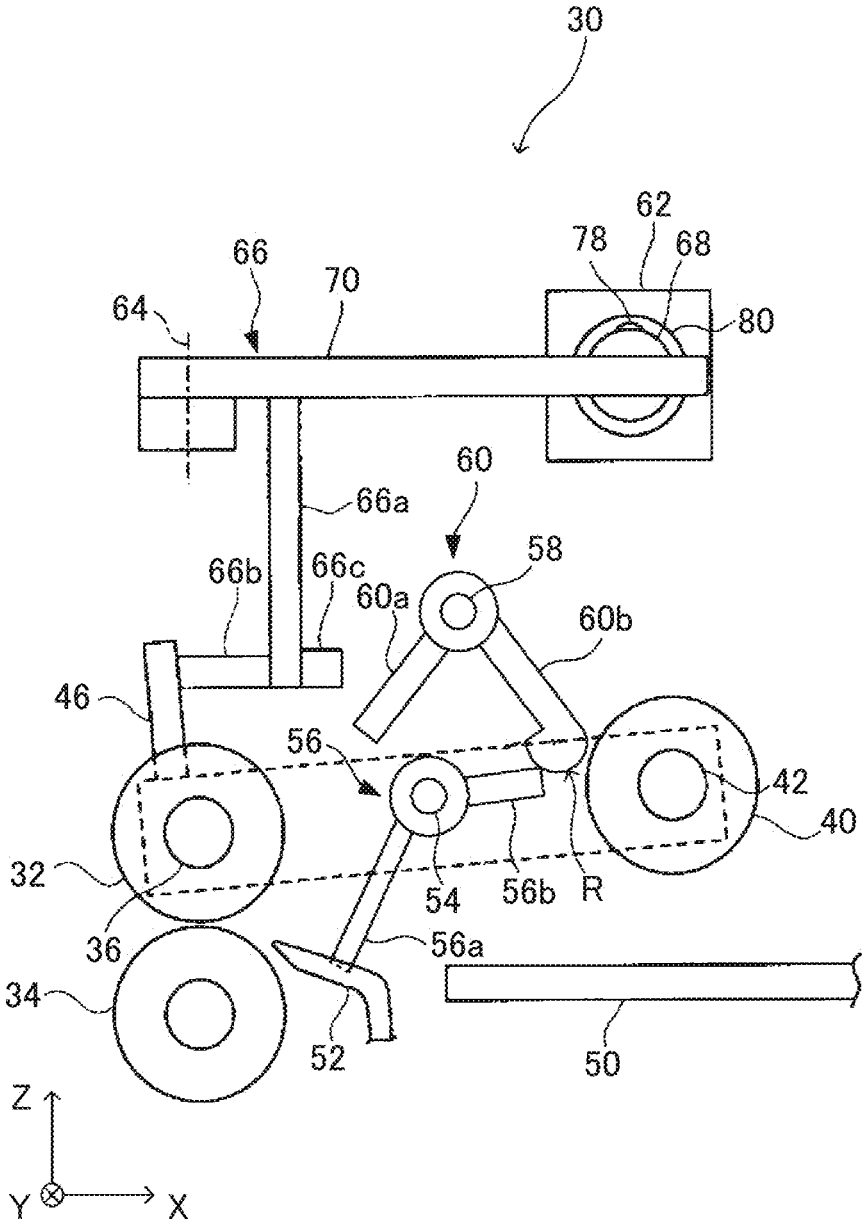
FIG. 12 is a side view of the sheet feeding device in a state in which rotation of a sheet stopper and a sheet stopper rotation restricting member stops in a state in which a tip end of a stopper second arm is in contact with a curved surface of a stopper locking projection.

FIG. 12 is a side view of the sheet feeding device 30 in a state in which the rotation of the sheet stopper 56 and the sheet stopper rotation restricting member 60 stops with the tip end of the stopper second arm 56*b* being in contact with the curved surface R of the stopper locking projection 61.

When the rotation stops in the state illustrated in FIG. 12, it is sometimes not possible to return to the state illustrated in FIG. 4 regardless of the presence or absence of the sheet S on the sheet feed tray 50 when the sheet feeding operation stops.

As in the state illustrated in FIG. 12, when the sheet feeding device 30 stops without fully returning to the state illustrated in FIG. 4, the sheet stopper 56 does not function when the sheet is replenished when the sheet S runs out or when changing a sheet size for a next printed material, and the sheet S is thrown in. If the sheet S is thrown in, this causes multiple feeding, deterioration in print quality, and sheet jam during printing described above.

Easiness of occurrence of the above-described equilibrium state varies depending on the device due to manufacturing errors and assembly errors of parts. If smoothness of the surface of the stopper second arm 56*b* and the curved surface R decreases with time, the frictional resistance increases, and the above-described equilibrium state is likely to occur.

Therefore, in the sheet feeding device 30 of this embodiment, when the sheet feeding operation finishes, that is, at the end of print job or when the sheet runs out, the operation described with reference to FIG. 8 is executed to drive the solenoid 62, and the pickup roller 40 is lowered again.

FIG. 1 is a flowchart illustrating an outline of a control flow of the sheet feeding device 30 at the time of printing in the copier 100.

Before the printing is started, the sheet feeding device 30 is in the state illustrated in FIG. 7, and when the printing is started, the sheet feeding operation described with reference to FIGS. 8 to 10 is executed.

During the sheet feeding operation, the controller 150 determines whether the sheet runs out or not based on a detection result of the sheet detection sensor 160 when starting conveying the next sheet at a predetermined timing after the trailing edge of the sheet S passes through the separation nip (S1). If it is determined by the detection of the sheet detection sensor 160 that it is in a sheet-out state in which there is no sheet S on the sheet feed tray 50 ("Yes" at S1), the driving of the sheet feeding motor 140 is stopped and the sheet feeding operation is finished (S2). Then, the operation of lowering the pickup roller 40 described with reference to FIG. 8 and the operation of raising the pickup roller 40 described with reference to FIG. 10 are executed once or a plurality of times (S3), and the printing is completed. When the print job is not finished when the printing is completed, the operation display 3 or the external device is notified that "sheet is run out".

When it is determined that the sheet is not run out ("No" at S1), it is determined whether or not the print job is finished (S4). When the print job is not finished ("No" at S4), the sheet feeding operation is continued. In contrast, when the print job is finished ("Yes" at S4), the driving of the sheet feeding motor 140 is stopped and the sheet feeding operation is finished (S2). Then, the operation of lowering the pickup roller 40 described with reference to FIG. 8 and the operation of raising the pickup roller 40 described with reference to FIG. 10 are executed once or a plurality of times (S3).

By executing the operation of lowering the pickup roller 40 in the state in which there is no sheet S in the sheet feed tray 50 in this manner, the sheet stopper rotation restricting member 60 rotates from a position in which the sheet stopper 56 may be restricted toward a position in which the restriction is released in conjunction with this operation.

When the sheet feeding operation is stopped, even if it is in the equilibrium state in which the inertia force by the inertia moment by the weight of the sheet stopper 56 and the force which prevents the movement by the frictional resistance described above are balanced, the equilibrium state may be resolved by the rotation of the sheet stopper rotation restricting member 60. Therefore, it is possible to resolve the equilibrium state of the sheet stopper 56 which has not yet reached the standby position due to the above-described equilibrium state after the sheet feeding operation is finished and move the same to the standby position, and return the sheet feeding device 30 to the state illustrated in FIG. 4.

If it is not in the equilibrium state and the sheet stopper 56 is at the standby position when the sheet feeding operation is stopped, the sheet stopper 56 remains at the standby position even if the sheet stopper rotation restricting member 60 is rotated.

In this manner, by performing a re-lowering operation of the pickup roller 40 after the sheet feeding operation is finished and rotating the sheet stopper rotation restricting member 60 in conjunction with this, even if the sheet stopper 56 is in the equilibrium state, this may be resolved. Accordingly, it is possible to prevent the state in which the sheet stopper 56 does not function at the time of sheet replenishment and prevent the throw-in of the sheet S.

During the sheet feeding operation, in a state in which the solenoid 62 is repeatedly switched between "ON" and "OFF", and the contact position between the tip end of the stopper second arm 56*b* and the curved surface R of the stopper locking projection 61 is moving, a frictional force acting on the two members becomes dynamic friction. Since the dynamic friction has a smaller frictional force than that of static friction, the above-described equilibrium state is unlikely to occur in a state in which the dynamic friction acts. In contrast, when relative movement between the curved surface R and the stopper second arm 56*b* stops for some reasons, the frictional force acting on the two members becomes the static friction, so that the frictional force becomes larger than that in the state in which the dynamic friction acts. At that time, at the stopped position, it is likely to be in a state in which the inertia force by the inertia moment by the weight of the sheet stopper 56 and the force which prevents the movement by the frictional resistance are balanced, and the above-described balanced state is likely to occur.

Regardless of whether or not such equilibrium state is likely to occur, by performing the re-lowering operation of the pickup roller 40 after the sheet feeding operation is finished and rotating the sheet stopper rotation restricting member 60 in conjunction with this, it is possible to suppress a trouble caused by the equilibrium state of the sheet stopper 56.

Next, an example of the sheet detection sensor 160 which detects that the sheet runs out is described.

Figure 13A:
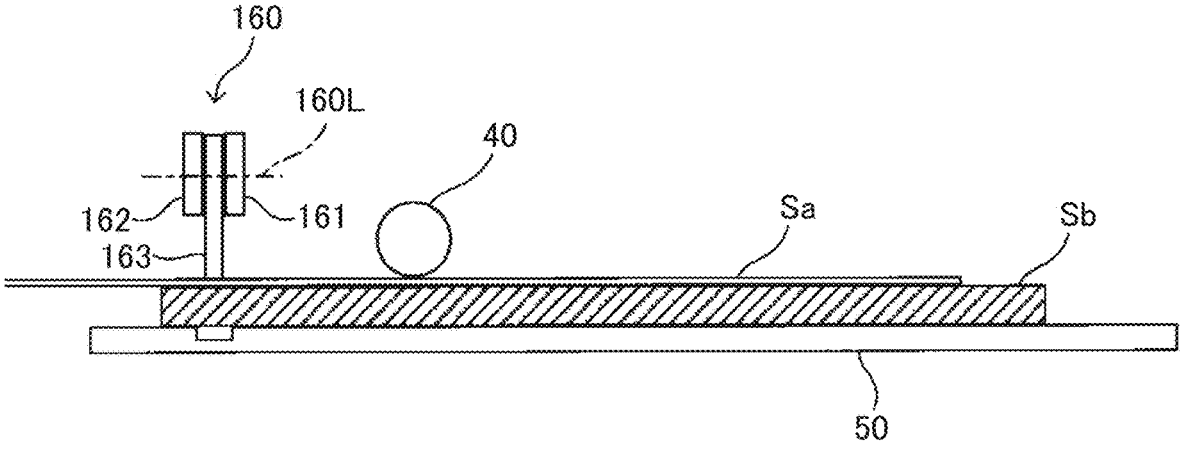
FIGS. 13A and 13B are schematic illustrative views of a configuration using a contact detecting mechanism as a sheet detection sensor.
Figure 13B:
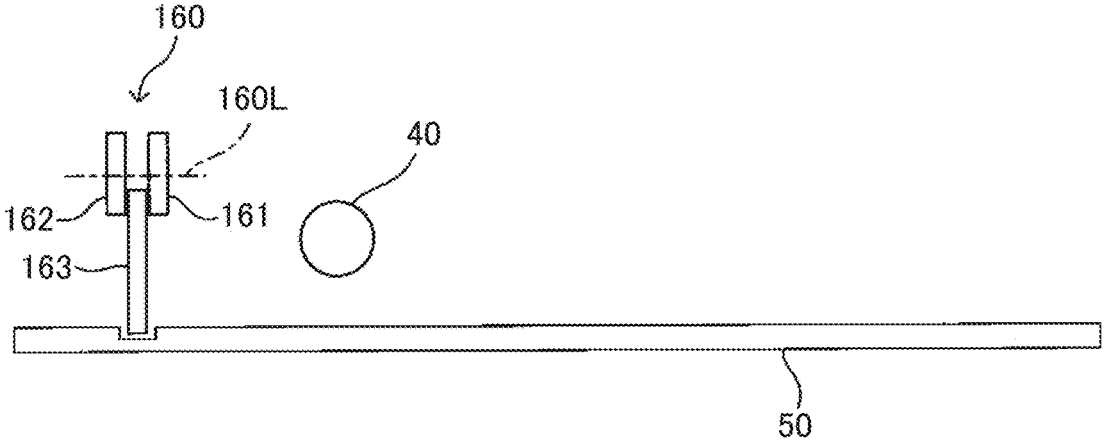

FIGS. 13A and 13B are schematic illustrative views of a configuration using a contact detecting mechanism as the sheet detection sensor 160. FIG. 13A illustrates a state in which the sheet does not run out, the state in which a sheet bundle Sb is placed on the sheet feed tray 50 and uppermost sheet in conveyance Sa is conveyed by the pickup roller 40. FIG. 13B illustrates a state in which the sheet does not run out, the state in which there is no sheet S on the sheet feed tray 50.

The sheet detection sensor 160 illustrated in FIGS. 13A and 13B includes a projector 161, a light receiver 162, and a sheet contacting feeler 163. This sheet detection sensor 160 detects whether a lifting position of the sheet contacting feeler 163 is higher or lower than a sensor optical axis 160L by using a transparent sensor formed of the projector 161 and the light receiver 162.

A basic structure of the transparent sensor is that the projector 161 incorporating a light source to serve to project light which becomes a detection medium and the light receiver 162 incorporating a light receiving element which receives projection light from the projector 161 and converts the same into an electrical signal are arranged so as to be opposed to each other. The light emitted from the projector 161 is projected straight onto a light incident window of the light receiver 162. A detection range is between the light projector 161 and the light receiver 162 arranged so as to be opposed to each other, and when an object which passes through this range blocks the projection light and an amount of light incident on the light receiver 162 decreases, an electric characteristic of a photoelectric conversion element incorporated in the light receiver 162 changes, so that this is detected and amplified to be an object detecting signal.

The sheet detection sensor 160 is arranged at a predetermined position of the sheet feeding device 30. In a state in which there is the sheet, as illustrated in FIG. 13A, the sheet contacting feeler 163 comes into contact with the upper surface of the sheet S to be in a raised position, and the sheet contacting feeler 163 may block the projection light of the transparent sensor.

In a sheet-out state, as illustrated in FIG. 13B, the sheet contacting feeler 163 falls freely and is in a lowered position and the sheet contacting feeler 163 does not block the projection light of the transparent sensor. Accordingly, it is possible to change a sensor detection signal in conjunction with the presence or absence of the sheet S in the sheet feed tray 50, and detect a sheet-out timing by monitoring the sensor detection signal in real time.

The sheet detection sensor 160 being a sheet-out detecting unit which detects sheet-out when the sheet feeding operation is finished in the sheet feeding device 30 is the contact detecting mechanism in which the sheet contacting feeler 163 comes into contact with the sheet S to detect the presence or absence of the sheet S. In the state in which the sheet S is placed in the sheet feed tray 50, the sheet contacting feeler 163 comes into contact with the sheet S, and by detecting a contacting state, the presence or absence of the sheet S may be detected and the sheet-out may be detected.

The sheet detection sensor 160 being a contact detecting mechanism is obtained by combining the sheet contacting feeler 163 and the transparent sensor (light projector 161 and light receiver 162) for detecting the lifting position of the sheet contacting feeler 163. With this configuration, the presence or absence of the sheet may be detected based on a change in position of the sheet contacting feeler 163.

The sheet detection sensor 160 which detects the presence or absence of the sheet S on the sheet feed tray 50 is not limited to that using the transparent sensor described with reference to FIGS. 13A and 13B. Any sensor may be used as long as this may detect the presence or absence of the sheet S such as a configuration using a reflective photosensor.

Figure 14A:
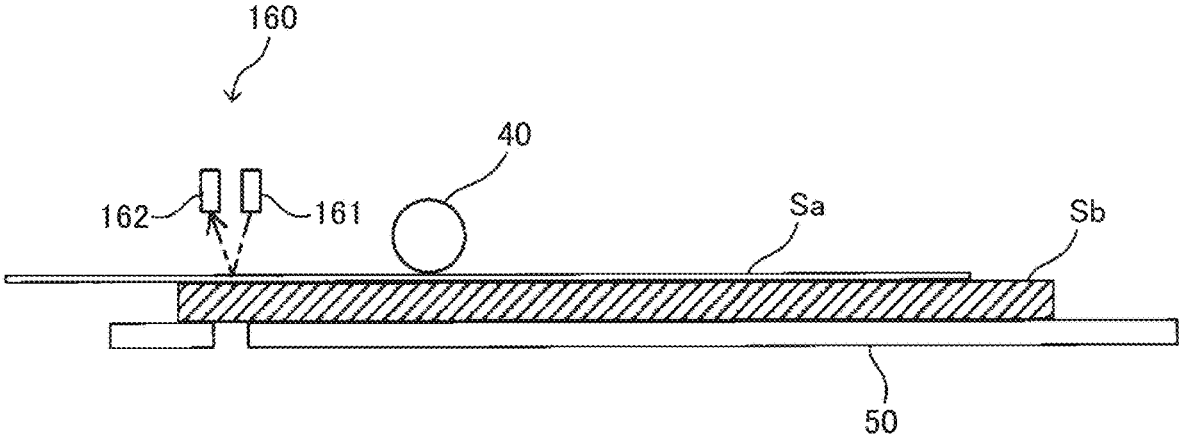
FIGS. 14A and 14B are schematic illustrative views of a configuration using a reflective photosensor being a non-contact detecting mechanism as the sheet detection sensor.
Figure 14B:
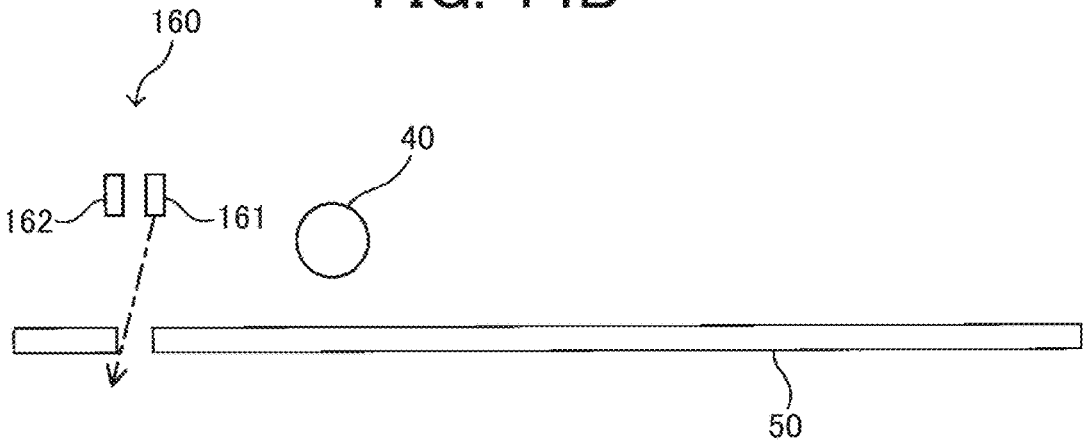

FIGS. 14A and 14B are schematic illustrative views of a configuration using the reflective photosensor being a non-contact detecting mechanism as the sheet detection sensor 160. FIG. 14A illustrates a state in which the sheet does not run out, the state in which a sheet bundle Sb is placed on the sheet feed tray 50 and an uppermost sheet in conveyance Sa is conveyed by the pickup roller 40. FIG. 14B illustrates a state in which the sheet does not run out, the state in which there is no sheet S on the sheet feed tray 50.

The sheet detection sensor 160 illustrated in FIGS. 14A and 14B including the projector 161 and the light receiver 162 forms the reflective photosensor. In the sheet detection sensor 160, when the sheet S is on the sheet feed tray 50 as illustrated in FIG. 14A, the light emitted from the projector 161 is reflected on the surface of the sheet S to be incident on the light receiver 162. In contrast, when there is no sheet S on the sheet feed tray 50 as illustrated in FIG. 14B, the light emitted from the projector 161 is not incident on the light receiver 162. In this manner, the amount of light incident on the light receiver 162 differs depending on the presence or absence of the sheet S, and the electrical characteristic of the photoelectric conversion element incorporated in the light receiver 162 changes, so that it is possible to detect and amplify the same to obtain the object detection signal, and detect the presence or absence of the sheet S.

By using the non-contact detecting mechanism like the sheet detection sensor 160 illustrated in FIGS. 14A and 14B, a mechanical element brought into contact with the sheet S becomes unnecessary, and the structure of the sheet detector which detects the presence or absence of the sheet may be simplified.

The non-contact detecting mechanism which detects the presence or absence of the sheet S without contacting the sheet S may be implemented by using the reflective photosensor like the sheet detection sensor 160 illustrated in FIGS. 14A and 14B.

The sheet feeding device 30 of the above-described embodiment includes the restricting member biasing torsion spring 63 which biases the sheet stopper rotation restricting member 60 to rotate in the clockwise direction in FIG. 4. In contrast, a biasing member such as a torsion spring which biases the sheet stopper 56 to rotate in the counterclockwise direction in FIG. 4 in order to return the sheet stopper 56 to the standby position is not included, and the sheet stopper 56 returns to the standby position by its own inertia moment. As a configuration of returning the sheet stopper 56 to the standby position, a biasing member such as a torsion spring which biases the sheet stopper 56 return to the standby position may be arranged.

By including the biasing member which returns the sheet stopper 56 to the standby position, a force with which the sheet stopper 56 returns to the standby position from the state illustrated in FIG. 11 when the sheet feeding operation is finished increases. For this reason, the force with which the stopper second arm 56*b* pushes up the stopper locking projection 61 from below increases, and a force with which the stopper second arm 56*b* moves along the curved surface R against the frictional resistance increases, so that the above-described equilibrium state is less likely to occur. However, for some reasons, the equilibrium state in which a combined force of the inertia force by the inertia moment by the weight of the sheet stopper 56 and the biasing force by the biasing member balances with the force preventing the movement by the frictional resistance might occur. Therefore, even with the configuration including the biasing member which biases the sheet stopper 56 to return to the standby position, it is desired to perform the re-lowering operation of the pickup roller 40 after the sheet feeding operation is finished and rotate the sheet stopper rotation restricting member 60 in conjunction with this. Thereby, even if the sheet stopper 56 is in the equilibrium state, the equilibrium state may be resolved.

As described with reference to FIGS. 8 and 9, when feeding the sheet, the conveyed sheet S contacts the sheet stopper 56 released from the restriction by the sheet stopper rotation restricting member 60, and the sheet S pushes the sheet stopper 56 to move the same from the standby position. Therefore, in the configuration including the biasing member which biases the sheet stopper 56 to return to the standby position, when soft sheet S such as thin sheet is set, there might be a disadvantage that the leading end of the sheet S is bent by the biasing force of the biasing member which biases the sheet stopper 56.

In contrast, the sheet feeding device 30 of this embodiment does not include the biasing member which actively biases the sheet stopper 56 so as to return to the standby position, and the sheet stopper 56 returns to the standby position with the inertia force of the inertia moment of its own weight. With such configuration, a resistance force when the conveyed sheet S pushes the sheet stopper 56 to move the same is small, and even when the soft sheet S such as the thin sheet is set, it is possible to prevent the leading end of the conveyed sheet S from bending.

As in the sheet feeding device 30 of this embodiment, in the configuration without the biasing member which biases the sheet stopper 56 to return to the standby position, the equilibrium state described with reference to FIG. 12 is likely to occur as compared to the configuration including the biasing member. However, the sheet feeding device 30 of this embodiment performs the re-lowering operation of the pickup roller 40 after the sheet feeding operation is finished, and rotates the sheet stopper rotation restricting member 60 in conjunction therewith. As a result, even if the equilibrium state of the sheet stopper 56 in which the sheet stopper rotation restricting member 60 and the sheet stopper 56 are in contact with each other and do not move occurs, it is possible to eliminate the same. Therefore, even with the configuration not including the above-described biasing member in which the equilibrium state is likely to occur, when the sheet S is set in the sheet feed tray 50, it is possible to locate the sheet stopper 56 at the standby position and restrict the movement of the sheet stopper 56 by the sheet stopper rotation restricting member 60. As a result, it is possible to align a leading end position of the sheet S set in the sheet feed tray 50 and to prevent occurrence of a trouble that the bundle of sheet S is thrown into the separation nip.

The configuration of rotating the sheet stopper rotation restricting member 60 in the clockwise direction in FIG. 4 is not limited to the configuration including the restricting member biasing torsion spring 63, and a configuration of rotating by the weight of the sheet stopper rotation restricting member 60 is also possible. In this configuration, as illustrated in FIG. 10, when the pressing of the link third arm 66*c* against the restricting member first arm 60*a* is released, the sheet stopper rotation restricting member 60 rotates in the clockwise direction in FIG. 10 by the inertia moment of its own weight.

In the configuration not including the restricting member biasing torsion spring 63, the sheet stopper 56 interlocking with a lifting operation of the pickup roller 40 is included and the sheet stopper rotation restricting member 60 is not actively biased by the biasing mean in the rotation restricting direction. Then, the pickup roller 40 is lifted up and down again when the sheet feeding operation is finished (end of job or sheet out). As a result, the sheet stopper rotation restricting member 60 is moved to a locking position where the sheet stopper rotation restricting member 60 locks the sheet stopper 56 only by the rotational force by the inertia moment by the weight of the sheet stopper rotation restricting member 60.

The copier 100 according to this embodiment has a configuration capable of setting so as not to perform the control of performing the re-lowering operation of the pickup roller 40 after the sheet feeding operation is finished. If the control of lowering the pickup roller 40 is executed every time the sheet feeding operation is finished, the pickup roller 40 is lowered even though sheet feeding is not performed to perform blank shot. Such blank shot might be annoying and uncomfortable for some users, so that it is possible to set not to perform the above-described control according to the user's request. Such a change in setting may be changed by the user, but it is desirable that an administrator such as a service person sets this according to the user's request.

The sheet feeding device 30 of this embodiment is applicable to the manual sheet feeding device 105 included in the copier 100 being the image forming apparatus. The sheet feeding device 30 includes the pickup roller 40 which contacts the sheet S placed on the sheet feed tray 50 and conveys the sheet S to the sheet feeding roller 32, and the solenoid 62 including the movable iron core 68 which moves linearly. The solenoid link 66 coupled to the movable iron core 68 of the solenoid 62 and rotatably provided is also included. The pickup arm 38 rotatably provided by the sheet feeding roller shaft 36 which rotatably supports the pickup roller 40 in a raising or lowering direction in conjunction with the rotational movement of the solenoid link 66 by the linear movement of the movable iron core 68 of the solenoid 62 is also included.

The sheet stopper 56 rotatably supported by the stopper shaft 54 being a first shaft and stops to align the leading end of the sheet S stacked on the sheet feed tray 50 is included. The sheet stopper rotation restricting member 60 rotatably supported by the restricting member shaft 58 being a second shaft which rotates in conjunction with the rotational movement of the solenoid link 66 by the linear movement of the movable iron core 68 of the solenoid 62, and may lock or release locking of the sheet stopper 56 is included. The sheet stopper rotation restricting member 60 restricts the rotation of the sheet stopper 56 in the sheet passing direction in a locked state, and enables the rotation of the sheet stopper 56 in the sheet passing direction in a lock released state.

Furthermore, the sheet feeding device 30 linearly moves the movable iron core of the solenoid 62 at least once regardless of the presence or absence of the remaining sheet S in the sheet feed tray 50 when the sheet feeding operation is finished, that is, at the time of job end or sheet out. By this linear movement, the pickup arm 38 rotates at least once in the direction of lowering the pickup roller 40 in conjunction with the solenoid link 66. That is, when the sheet feeding operation is finished, the operation of lowering the pickup roller 40 again is executed once or a plurality of times.

As described above, the sheet feeding device 30 includes the sheet stopper 56. In the sheet feeding device 30, there is a risk that the sheet bundle including more than the expected number of sheets of sheet S enters between the sheet feeding roller 32 and the separation roller 34 located on an inner side of the pickup roller 40 and the multiple feeding occurs; however, when the sheet stopper 56 is included, this trouble may be prevented. However, if the sheet stopper 56 stops in the equilibrium state described with reference to FIG. 12 after the sheet feeding operation is finished, the function of the sheet stopper 56 cannot be exhibited at the time of setting operation of the next sheet S. In contrast, the sheet feeding device 30 of this embodiment performs the re-lowering operation of the pickup roller 40 after the sheet feeding operation is finished and rotates the sheet stopper rotation restricting member 60 in conjunction therewith. As a result, even when the sheet stopper 56 is in the equilibrium state, it is possible to resolve this, and the function of the sheet stopper 56 may be exhibited at the time of the setting operation of the next sheet S, thereby preventing the occurrence of the multiple feeding described above.

The sheet feeding device 30 according to this embodiment moves the pickup roller 40 up and down in conjunction with the operation of rotating the sheet stopper rotation restricting member 60 by driving the solenoid 62, thereby bringing the same into contact with and separating the same from the sheet S on the sheet feed tray 50. With this configuration, the number of driving sources may be reduced as compared to a configuration in which a driving source which rotates the sheet stopper rotation restricting member 60 and a driving source which brings the pickup roller 40 into contact with and separates the same from the sheet S are provided separately. Therefore, the apparatus may be simplified and a cost may be reduced.

The sheet feeding device 30 according to the above-described embodiment includes the pickup roller 40, and conveys the sheet S by the pickup roller 40 to the position of the sheet feeding roller 32 on a downstream side of a sheet stopping position at which the sheet stopper 56 stops movement of the sheet S to the downstream side. The configuration of the sheet feeding device 30 is not limited to that including the pickup roller 40. For example, the sheet S placed on the sheet feed tray 50 may be moved to the position of the sheet feeding roller 32 by inclination of the sheet feed tray 50. In this configuration, the sheet stopper rotation restricting member 60 and the solenoid 62 which moves the sheet stopper rotation restricting member 60 are included. The sheet stopper rotation restricting member 60 may move between a restricting position (locking position)

at which the sheet stopper 56 is locked and the movement of the sheet stopper 56 from the standby position is restricted, and a releasing position (lock releasing position) moved from the restricting position to release the restriction of the sheet stopper 56. Then, by switching the solenoid 62 between "ON" and "OFF", the sheet stopper rotation restricting member 60 is moved between the restricting position and the releasing position described above.

In the configuration not including the pickup roller 40, control to turn the solenoid 62 "ON" after the sheet feeding operation is finished and then turn the same "OFF" is executed. As a result, even if a state similar to the equilibrium state of the above-described embodiment occurs, the equilibrium state may be resolved and the sheet stopper 56 may function.

The image forming apparatus including the sheet feeding device according to the present invention is not limited to the copier. The sheet feeding device according to the present invention may be used in an image forming apparatus having functions of a printing device, an inkjet recording device, a printer, a copier, or a facsimile.

The image forming apparatus including the sheet feeding device according to the present invention is not limited to the electrophotographic apparatus such as the copier 100 described above, but this may also be applied to an inkjet apparatus.

The sheet conveyed by the sheet feeding device according to the present invention is not limited to the recording medium such as the sheet S. The sheet feeding device is not limited to a sheet feeding device such as a manual sheet feeding device used in the image forming apparatus, and is applicable to any apparatus other than the image forming apparatus as long as this is a device which feeds a plurality of stacked sheets.

The device which feeds a plurality of stacked sheets is also applicable to an automatic document feeder such as the ADF 200 illustrated in FIG. 2. The ADF 200 illustrated in FIG. 2 feeds an uppermost sheet of a bundle of documents placed on a document table 201 into a main body of the ADF 200, allows the same to pass through a reading position by the scanner 300, and ejects the same to a document ejection tray 202. As a document feeding unit which feeds the document placed on the document table 201 in the ADF 200, the sheet feeding device according to the present invention having a configuration similar to that of the above-described sheet feeding device 30 may be applied.

The sheet to be fed by the sheet feeding device according to the present invention includes not only a sheet-shaped member but also a thin plate-shaped member. Sheets include paper, cloth, a resin sheet, protective paper on front and back surfaces, a metal sheet, an electronic circuit board material plated with a metal foil such as a copper foil or treated with plating, a special film, a plastic film, a prepreg, a sheet for electronic circuit board and the like.

The prepreg is a sheet-shaped material obtained by impregnating a carbon fiber or the like with a resin in advance. An example of the prepreg includes a sheet-shaped reinforced plastic molding material obtained by impregnating a fibrous reinforcing material such as carbon fiber or glass cloth with a thermally curable resin mixed with additives such as a curing agent and a colorant, and heating or drying the same to put into a semi-cured state.

The above-described one is an example, and following each aspect has a unique effect.

First Aspect

A sheet feeding device such as a sheet feeding device 30 provided with: a feeder such as a sheet feeding roller 32 which feeds a sheet such as a sheet of paper S; a contact member such as a sheet stopper 56 which a leading end of the sheet in a feeding direction contacts; a movement restricting member such as a sheet stopper rotation restricting member 60 which locks the contact member to restrict movement of the contact member from a contact position such as a standby position where the contact member contacts the sheet; and a moving mechanism such as a solenoid 62 which moves the movement restricting member between a locking position in which the contact member is locked (restricting position illustrated in FIG. 7 and the like) and a lock releasing position in which the locking is released (releasing position illustrated in FIG. 8 and the like), the contact member taking the contact position by gravity or a biasing force of a biasing part, the sheet feeding device provided with: a controller such as a controller 150 which executes control (control to lowering a pickup roller 40 again) to control the moving mechanism to move the movement restricting member to the lock releasing position and then to the locking position when a feeding operation of the sheet is finished.

As a result of diligent studies by the inventors, it is understood that, in a conventional sheet feeding device, when the feeding operation is finished, the contact member about to move to the contact position comes in contact with the movement restricting member, so that the contact member sometimes stops without reaching the contact position. This might be caused by an equilibrium state in which a force which prevents the contact member from moving by friction in a contact portion between the contact member and the movement restricting member balances with a force with which the contact member moves to the contact position.

In the first aspect, even if it is in the equilibrium state when the feeding operation of the sheet is finished, by moving the movement restricting member to the lock releasing position, it is possible to release the equilibrium state and return the contact member to the contact position. Furthermore, by moving the movement restricting member to the locking position thereafter, the movement restricting member may be locked to the contact member at the contact position, and the movement of the contact member from the contact position may be restricted. Accordingly, the movement of the sheet downward in a feeding direction from a position in which this contacts the contact member may be prevented when the sheet is set after the feeding operation of the sheet is finished.

Second Aspect

In the first aspect, the contact member is supported so as to be rotatable with respect to a device body (housing of the sheet feeding device 30) by a contact member rotary shaft such as a stopper shaft 54 and rotates to move between the contact position and another position, the movement restricting member locks the contact member to restrict rotation of the contact member at the contact position in the feeding direction, and the contact member at the contact position becomes rotatable in the feeding direction when the locking of the contact member by the movement restricting member is released.

According to this, when the movement restricting member locks the contact member, the rotation of the contact member at the contact position in the feeding direction is restricted, and the movement of the sheet downward in the feeding direction from the position where this contacts the contact member may be prevented. When the locking of the contact member by the movement restricting member is released, the contact member located at the contact position may be rotated in the feeding direction, and the sheet about to move in the feeding direction pushes the contact member, so that the contact member rotates in the conveyance direction. As a result, the state in which the leading end of the sheet in the feeding direction contacts the contact member may be released, and the sheet may be fed.

Third Aspect

In the first or second aspect, the movement restricting member is rotatably supported with respect to the device body (housing of the sheet feeding device 30) by a restricting member rotary shaft such as the restricting member shaft 58, rotates by transmission of a moving force from the moving mechanism, and moves between the locking position and the lock releasing position.

According to this, by rotating the movement restricting member, it is possible to implement a configuration to switch between a restricting state to restrict the movement of the contact member and a state in which the restriction is released.

Fourth Aspect

In any one of the first to third aspects, a conveying member such as a pickup roller 40 located on an upstream side of the feeder in the feeding direction and comes into contact with the sheet placed on a placing member such as a sheet feed tray 50 on which the sheet is placed to convey the sheet toward the feeder is provided, in which the conveying member is brought into contact with and separated from the sheet on the placing member in conjunction with an operation of the moving mechanism to move the movement restricting member.

According to this, the number of driving sources may be reduced from a configuration in which a driving source for moving the movement restricting member and a driving source for bringing the conveying member into contact with and separating the same from the sheet are separately provided, thereby simplifying the device and reducing a cost.

Fifth Aspect

In the fourth aspect, the moving mechanism includes a linear core member such as a movable iron core 68 which linearly moves by driving, includes a rotating member such as a solenoid link 66 coupled to the linear core member to perform rotational movement by linear movement of the linear core member, and the movement restricting member moves between the locking position and the lock releasing position in conjunction with the rotational movement of the rotating member.

According to this, a configuration of moving the movement restricting member by the linear movement of the moving mechanism may be implemented.

Sixth Aspect

In the fourth or fifth aspect, a position of the conveying member is a position in which the conveying member is able to come into contact with the sheet on the placing member when the movement restricting member is at the lock releasing position, and a position in which the conveying member does not come into contact with the sheet on the placing member when the movement restricting member is at the locking position.

According to this, when the conveying member is brought into contact with the sheet, it is possible to put into a state in which the sheet does not contact the contact member even when the movement restriction of the contact member is released and the sheet is conveyed by the conveying member. When the conveying member is not brought into contact with the sheet, it is possible to put into a state in which the movement of the contact member from the contact position is restricted and the movement of the sheet downward in the feeding direction from the position in which the sheet contacts the contact member is prevented.

Seventh Aspect

In any one of the first to sixth aspects, a placing member such as a sheet feed tray 50 on which the sheet fed by the feeder is placed; and a sheet detector such as a sheet detection sensor 160 which detects presence or absence of the sheet in the placing member are provided, in which, when the sheet detector detects that there is no sheet, the controller finishes the feeding operation of the sheet. According to this, when the sheet on the placing member runs out, it is possible to execute control of moving the movement restricting member to a restriction releasing position and then to the locking position considering that the feeding operation of the sheet is finished. As a result, when the sheet on the placing member runs out, even in a state in which the contact member is in the balanced state and does not reach the contact position, it is possible to move the movement restricting member to the restriction releasing position to resolve the equilibrium state and move the contact member to the contact position. Therefore, when the sheet on the placing member runs out, it is possible to prevent the sheet from moving downward in the feeding direction from the position in which the sheet contacts the contact member when a user tries to set the sheet held by a user's hand on the placing member.

Eighth Aspect

In the seventh aspect, the sheet detector is a contact detecting mechanism which comes into contact with the sheet placed on the placing member.

According to this, it is possible to detect whether or not a contact portion such as a sheet contacting feeler 163 of the contact detecting mechanism is in contact with the sheet, thereby detecting the presence or absence of the sheet on the placing member.

Ninth Aspect

In the seventh aspect, the sheet detector is a non-contact detecting mechanism such as a reflective photosensor which detects presence of absence of the sheet without coming into contact with the sheet placed on the placing member.

According to this, by detecting the presence or absence of the sheet by the non-contact detecting mechanism, a mechanical element brought into contact with the sheet becomes unnecessary, and the structure of the sheet detector which detects the presence or absence of the sheet may be simplified.

Tenth Aspect

An image forming apparatus such as a copier 100 provided with: an image forming device such as an image forming device 110 which forms an image on a recording medium such as sheet-shaped sheet S; and a recording medium feeder which feeds the recording medium toward the image forming device, the image forming apparatus provided with: the sheet feeding device such as the sheet feeding device 30 according to any one of the first to ninth aspects as the recording medium feeder.

According to this, as described in the above embodiment, the contact member may be returned to the contact position when the feeding operation is finished, and it is possible to prevent the sheet from moving downward in the feeding direction from the position in which this contacts the contact member at the time of sheet setting after the feeding operation of the sheet is finished. Therefore, it is possible to prevent occurrence of multiple feeding and skewing caused when the sheet enters the downstream side in the feeding direction from the position where the sheet set at the time of sheet setting contacts the contact member and perform stable feeding of the recording medium, so that stable image forming may be performed.

Eleventh Aspect

In the tenth aspect, the sheet feeding device is a manual sheet feeding device such as a manual sheet feeding device 105 which feeds the recording medium such as the sheet S placed on a manual sheet feed tray such as a manual sheet feed tray 104.

According to this, with the manual sheet feed tray, a trouble that the sheet enters the downstream side in the feeding direction from the position where the sheet set at the time of sheet setting contacts the contact member easily occurs; however, this trouble may be prevented by returning the contact member to the contact position when the feeding operation is finished.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

Any one of the above-described operations may be performed in various other ways, for example, in an order different from the one described above. Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A sheet feeding device comprising:

a feeder and a pick-up roller, configured to feed a sheet;

a contact member which a leading end of the sheet in a feeding direction is to contact;

a movement restricting member configured to lock the contact member to restrict movement of the contact member from a contact position where the contact member contacts the sheet;

a moving mechanism configured to move the movement restricting member between a locking position at which the movement restricting member locks the contact member and a lock releasing position at which the movement restricting member releases locking of the contact member, the contact member being configured to take the contact position by gravity or a biasing force of a biasing part;

control circuitry configured to control the moving mechanism to move the movement restricting member to the lock releasing position and then to the locking position when a feeding operation of the sheet is finished;

a placing member on which a sheet fed by the feeder is placed; and a sheet detector configured to detect presence or absence of a sheet on the placing member, wherein, when the sheet detector detects that no sheet is on the placing member, the control circuitry finishes the feeding operation of the sheet and subsequently lowers and raises the pickup roller at least once.

2. The sheet feeding device according to claim 1, further comprising a contact member rotary shaft configured to support the contact member so that the contact member is rotatable with respect to a device body, wherein the contact member rotates to move between the contact position and another position, wherein the movement restricting member locks the contact member to restrict rotation of the contact member at the contact position in the feeding direction, and wherein the contact member at the contact position becomes rotatable in the feeding direction when the locking of the contact member by the movement restricting member is released.

3. The sheet feeding device according to claim 1, further comprising a restricting member rotary shaft configured to support the movement restricting member so that the movement restricting member is rotatable with respect to a device body, wherein the movement restricting member rotates by transmission of a moving force from the moving mechanism and moves between the locking position and the lock releasing position.

4. The sheet feeding device according to claim 1, further comprising:

a placing member on which the sheet is placed; and a conveying member located on an upstream side of the feeder in the feeding direction and configured to contact the sheet placed on the placing member to convey the sheet toward the feeder, wherein the conveying member is brought into contact with and separated from the sheet on the placing member in conjunction with an operation of the moving mechanism to move the movement restricting member.

5. The sheet feeding device according to claim 4, wherein the moving mechanism includes:

a linear core member configured to linearly move by driving; and a rotating member coupled to the linear core member to perform rotational movement by linear movement of the linear core member, and wherein the movement restricting member moves between the locking position and the lock releasing position in conjunction with the rotational movement of the rotating member.

6. The sheet feeding device according to claim 4, wherein the conveying member is at a position at which the conveying member is contactable with the sheet on the placing member when the movement restricting member is at the lock releasing position, and a position at which the conveying member is not in contact with the sheet on the placing member when the movement restricting member is at the locking position.

7. The sheet feeding device according to claim 1, wherein the sheet detector is a contact detecting mechanism configured to contact the sheet placed on the placing member to detect the presence or absence of the sheet on the placing member.

8. The sheet feeding device according to claim 1, wherein the sheet detector is a non-contact detecting mechanism configured to detect the presence of absence of the sheet without contacting the sheet on the placing member.

9. An image forming apparatus comprising:

an image forming device configured to form an image on a sheet-shaped recording medium; and the sheet feeding device according to claim 1 configured to feed the recording medium toward the image forming device.

10. The image forming apparatus according to claim 9, wherein the sheet feeding device is a manual sheet feeding device configured to feed the recording medium placed on a manual paper feeding tray.

* * * * *